US006219974B1

(12) United States Patent
Hoberman

(10) Patent No.: US 6,219,974 B1
(45) Date of Patent: Apr. 24, 2001

(54) REVERSIBLY EXPANDABLE STRUCTURES HAVING POLYGON LINKS

(76) Inventor: Charles Hoberman, 472 Greenwich St., New York, NY (US) 10013

( * ) Notice: Subject to any disclaimer, the term of this patent is extended or adjusted under 35 U.S.C. 154(b) by 0 days.

(21) Appl. No.: 09/360,957

(22) Filed: Jul. 27, 1999

Related U.S. Application Data

(63) Continuation-in-part of application No. 09/154,482, filed on Sep. 16, 1998, now Pat. No. 6,082,056.

(51) Int. Cl.[7] ..... E04B 7/08

(52) U.S. Cl. ..... 52/81.5; 52/80.1; 52/81.1; 52/109; 52/646; 52/DIG. 10; 446/478; 446/487

(58) Field of Search ..... 52/81.2, 81.3, 52/81.5, 109, 645, 646, 653.1, 80.1, 81.1, 71, DIG. 10, 745.07, 745.08, 648.1; 446/486–488, 478

(56) References Cited

U.S. PATENT DOCUMENTS 4,942,700 * 7/1990 Hoberman ..... 52/81
5,024,031 * 6/1991 Hoberman ..... 52/81
5,540,013 * 7/1996 Diamond ..... 52/70
5,761,871 * 6/1998 Atake ..... 52/653.1

* cited by examiner

*Primary Examiner*—Carl D. Friedman
*Assistant Examiner*—Yvonne M. Horton
(74) *Attorney, Agent, or Firm*—Lieberman & Nowak, LLP

(57) ABSTRACT

Reversibly expandable structures are formed from loop assemblies comprising interconnected pairs of polygonal shaped links. Each loop assembly has polygon links with at least three pivot joints and at least some of the polygon links have more than three pivot joints. Additionally, these links lie essentially on the surface of the structure or parallel to the plane of the surface of the structure. Each polygon link has a center pivot joint for connecting to another link to form a link pair. Each link also has at least one internal pivot joint and one perimeter pivot joint. The internal pivot joints are used for connecting link pairs to adjacent link pairs to form a loop assembly. Loop assemblies can be joined together and/or to other link pairs through the perimeter pivot joints to form structures. In one preferred embodiment of the present invention link pairs may be connected to adjacent link pairs in a loop assembly through hub elements that are connected at the respective internal pivot joints of the two link pairs. Similarly hubs elements can be used to connect loop assemblies together or loop assemblies to other link pairs through the perimeter pivot joints. In yet another embodiment of the present invention the pivot joints can be designed as living hinges.

24 Claims, 18 Drawing Sheets

108
110
114
115
117
119
120
121
125
130
131
134
135
137
139
140
141
145
150
151
154
155
157
159
160
161
165
170
180

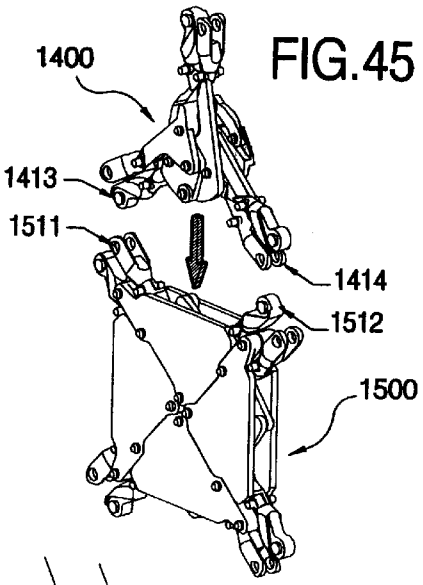
FIG.45
FIG.46
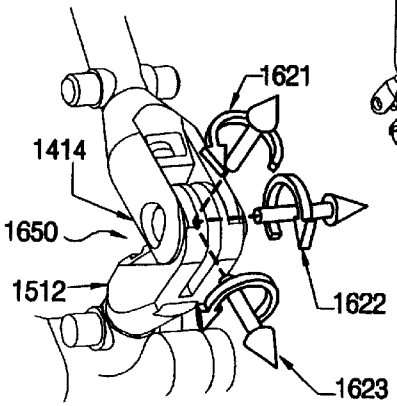
FIG.47
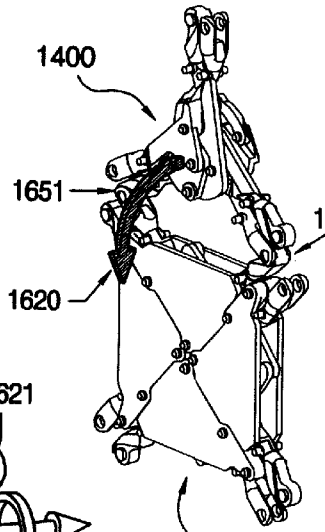
FIG.48
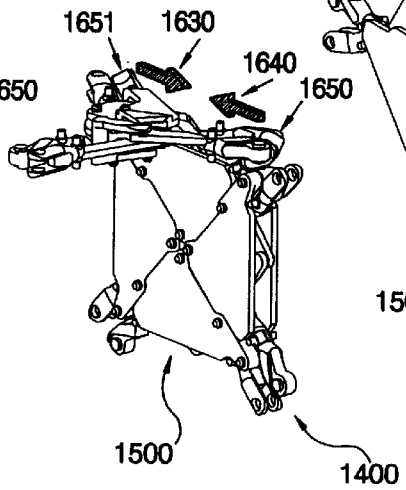
FIG.49
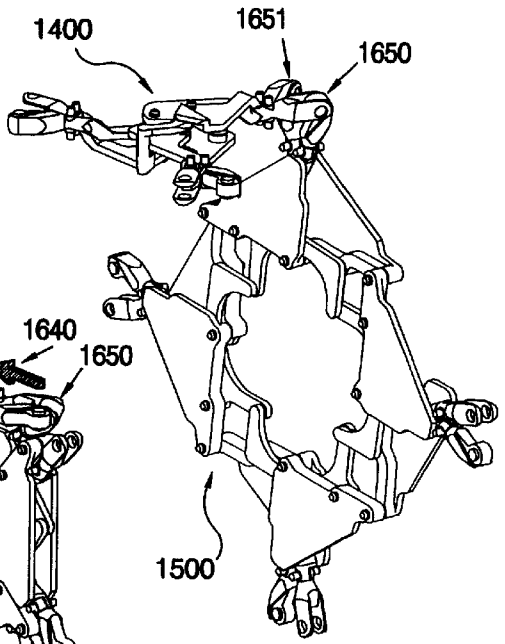
FIG.50

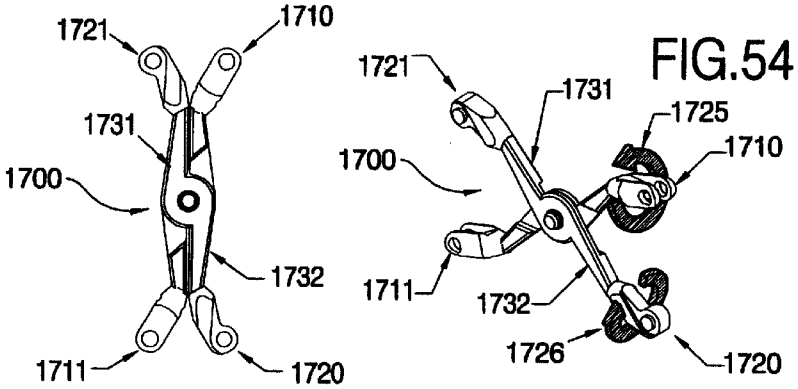
FIG.53
FIG.54
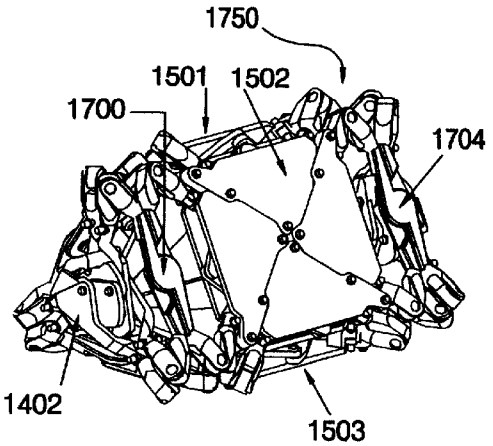
FIG.55
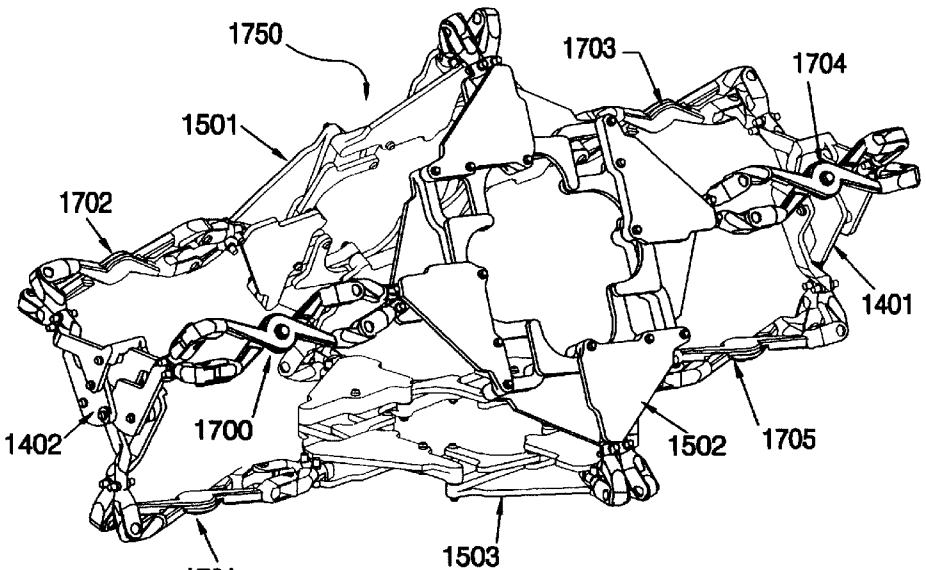
FIG.56

REVERSIBLY EXPANDABLE STRUCTURES HAVING POLYGON LINKS

RELATED APPLICATIONS

This is a continuation-in-part of U.S. patent application Ser. No. 09/154,482, filed Sep. 16, 1998, now U.S Pat. No. 6,082,056.

BACKGROUND OF THE INVENTION

U.S. Pat. Nos. 4,942,700 and 5,024,031, hereby incorporated by reference as if fully disclosed herein, disclose a method for constructing reversibly expandable truss-structures in a wide variety of shapes and the teachings therein have been used to build structures for diverse applications including architectural uses, public exhibits and unique folding toys.

In accordance with the teaching of the '700 patent, the resulting structures comprise substantially linear, but angulated, strut elements and smaller hub elements that are pivotally connected. The angulated struts always have three pivot points, one central pivot point and two terminal pivot points, and they lie in planes that are essentially orthogonal to the surface of the structure. Utilizing the methods taught in the '700 patent, one may construct foldable structures in a wide variety of shapes. However, certain shapes are more practical to construct in order to maintain a reasonable part count, have good structural integrity and ease of movement. In particular, the method is better suited to structures whose shape has a gentle curvature, rather than sharp corners. Also, the parts that make up a given structural shape will, in general, be unique to that particular shape. Therefore, it is not a simple matter to make a kit of interchangeable parts that may be used in different shaped structures.

SUMMARY OF THE INVENTION

In accordance with the present invention reversibly expandable structures are formed from loop assemblies comprising interconnected pairs of polygonal shaped links which lie essentially on the surface of the structure or parallel to the plane of the surface of the structure. The polygon links in the loop assembly have at least three pivot joints. At least some of the polygon links however, have more than three pivot joints. One of the pivot joints on each link is a center pivot joint for connecting to another link to form a link pair. Each link also has at least one internal pivot joint and one perimeter pivot joint. The internal pivot joints are used for interconnecting adjacent link pairs to form the loop assembly. Finally, loop assemblies can be joined together and/or to other link pairs through the perimeter pivot joints to form structures.

In one preferred embodiment of the present invention link pairs may be connected to adjacent link pairs to form a loop assembly through hub elements that are connected at the respective internal pivot joints of the two link pairs. Similarly hubs elements can be used to connect loop assemblies together or loop assemblies to other link pairs through the perimeter pivot joints to form structures. In yet another embodiment of the present invention the pivot joints can be designed as living hinges as described more fully below.

Structures built in accordance with the subject invention have specific favorable properties, including: a) The ability to use highly rigid materials rather than bending or distortion of the mechanical links, allowing for a smooth and fluid unfolding process; b) The use of compact, structurally favorable and inexpensive joints in the form of simple pivots; c) Retaining the strength and stability of the structure during folding and unfolding since all movement in the structure is due to the actual deployment process, without floppiness in the structure; d) A wide range of geometries; e) Inexpensive manufacture of structures with flexible hinges that are formed continuously with the links themselves; f) Convenient assembly of structures of many different shapes through kits of the necessary parts; and g) The ability to create a 'space-filling' structure by arranging linkages in a three-dimensional matrix.

BRIEF DESCRIPTION OF THE DRAWINGS

The invention will be further described with reference to the accompanying drawings wherein:

FIGS. 45–50 show how loop assemblies having a special perimeter corner joint may function as elements of a "snap-together" kit for making reversibly expandable structures.

FIGS. 53–54 show another element in a kit for making reversible expandable structures, a scissor pair that may be attached to loop assemblies.

FIGS. 55–56 show a prism-shaped structure that incorporates scissor pairs in its closed and opened state.

DETAILED DESCRIPTION OF THE INVENTION

Figure 3:
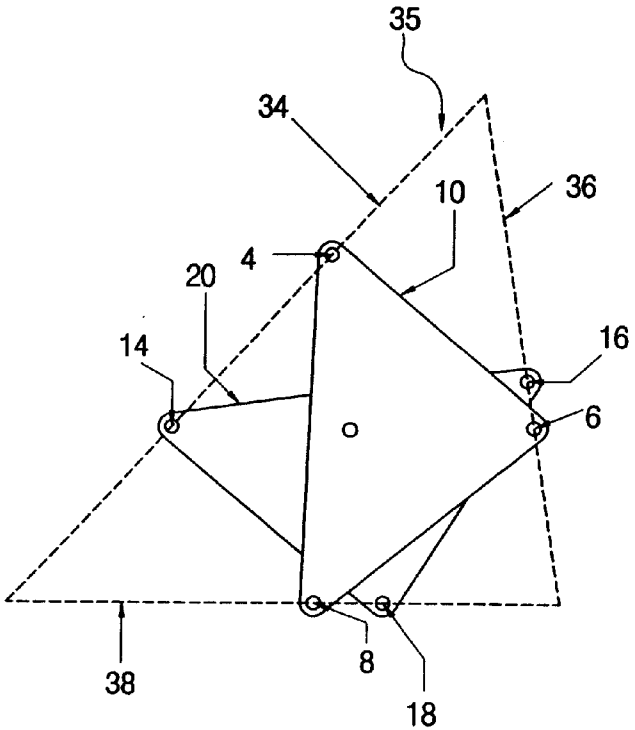
FIGS. 2–3 are plan views of a linked pair of polygon links.

The present invention relates to a new reversible expandable loop assembly formed by connecting at least three link pairs, and reversibly expandable structures which are created from multiple interconnected loop assemblies and/or link pairs. Each link pair comprises two links i.e., polygon links, each having a polygonal profile with three or more corners, a central joint and a corner pivot joint proximate to at least two of the three or more corners. The central joint is used to connect the two links together. The corner pivot joints comprise at least one internal corner pivot joint and at least one perimeter corner pivot joint. To form the loop assembly each link pair is connected to at least two adjacent link pairs through at least one of its internal corner pivot joints.

When the loop assembly stands alone, the perimeter corner joints of the links are not connected to anything. The perimeter corner joints, however, are used to connect loop assemblies together and/or loop assemblies to link pairs to form expandable structures.

The polygon links of the present invention can be made from any suitable material, ascertainable by one skilled in the art. Examples of suitable material include metal, plastic and wood.

Loop assemblies formed in accordance with the present invention can expand and retract. In many cases the geometry of the perimeter outline of the loop assembly will remain constant in all positions, with only a change in size. Each loop assembly can be identified by a ring of line-segments formed by intersecting the perimeter corner joints of the link pairs. This property is a result of constructing the loop assembly such that the angle formed between any two line-segments corresponding to a particular two link pairs in a given position of the loop assembly, is the same as the similarly formed angle between the line segments corresponding to the same two link pairs for any other position of the loop assembly.

There are two aspects to finding the correct location of pivot points such that this particular property is obtained.

First, an arrangement of links must be found such that the loop-assembly does fold freely, that is, it does not lock up. This ability to fold is not guaranteed. For example, by applying the equation to determine the degrees of freedom of a typical planar loop assembly, the result will be negative, indicating a over determined (i.e. locked) condition.

Therefore, the ability to fold is dependent on particular geometric conditions. When constructing a planar loop-assembly, an aid to determining possible location of pivot points, is to draw a four sided shape that connects the center joint from one link-pair to two of its interior corner joints, and then in turn connecting those corner joints to the center joint of its neighboring link-pair. According to a typical construction, all such quadrilaterals similarly drawn within a loop-assembly should be parallelograms.

If all these parallelograms are similar (have identical angles) the loop-assembly will definitely fold. However, it is possible to construct foldable loop assemblies with dissimilar parallelograms, and indeed to form foldable loop-assemblies where the quadrilaterals, and indeed to form foldable loop-assemblies where the quadrilaterals are not parallelograms at all. These alternative constructions require other symmetric arrangements that may be discovered through deeper study and inquiry.

Once a foldable loop-assembly is constructed, the location of the perimeter corner joints must be considered. The goal is to ensure that line segments drawn through paired perimeter corner joints maintain a constant angle relative to one another as the loop assembly is folded.

In a similar fashion to finding rules for constructing foldable loop-assemblies, we can find rules for locating perimeter corner joints that will always work. If, for example, each link-pair in a given foldable loop-assembly is comprised of two polygon links having identical relative locations of their perimeter and interior corner-joints, the angles between line segments will remain constant. Generally, paired polygon links that are similar in shape, but different in size will have this property as well. However, there are alternative arrangements that exist as well.

As explained above the position of the pivot joints are critical to the function of the loop assemblies and structures of the present invention. The profile of the links, however, are less critical and more design related. It will be apparent to one of ordinary skill in the art that so long as the pivot holes are the same, the links can have most any geometry. The selection of geometries thus is primarily one of creative design choice. However, it will also be obvious to one skilled in the art that certain polygon shapes may restrict the ability of the structure to reach a fully expanded or fully retracted position.

The loop assemblies and structures in accordance with the present invention have many applications including: medical devices, toys, architectural design and displays.

Figure 1:
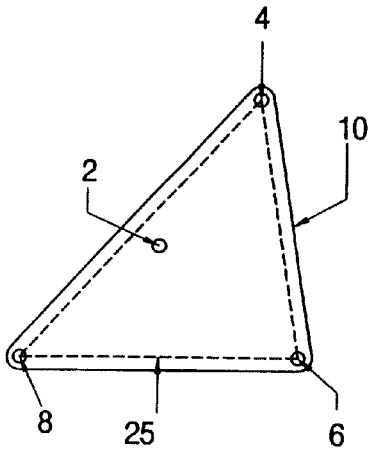
FIG. 1 is a plan view of the basic polygon link element of the invention.

Referring now more particularly to the drawings, shown in FIG. 1 is a link 10, which has a triangular shape and four pivot holes. Pivot hole 2 is in the central region of the link hereinafter the "center joint," and pivot holes 4, 6, and 8 are proximate to the corners of the link. A dashed line 25 is drawn connecting the center of the three corner-pivot holes 4, 6, and 8 hereinafter "corner joints," forming a triangle.

Figure 2:
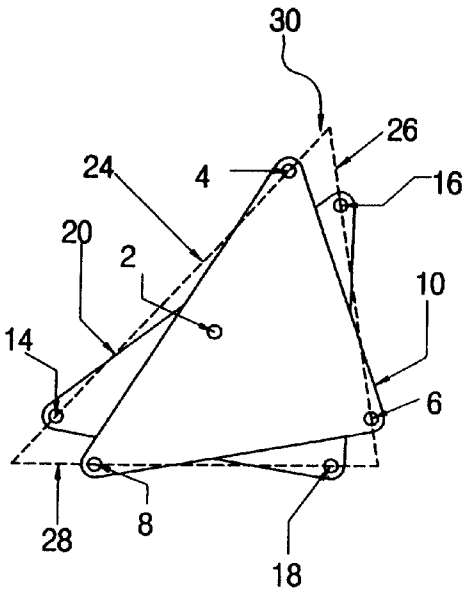

Referring to FIG. 2 the polygon link 10 of FIG. 1 is linked to a second polygon link 20 by center joint 2 to form a link pair. Links 10 and 20 have essentially the same profile and pivot hole locations. A dashed line 24 is shown passing through the center of paired corner joints 4, 14. Similarly, dashed line 26 passes through 6, 16, and dashed line 28 passes through 8, 18. The triangle 30 formed by lines 24, 26, and 28 has essentially the same shape as dashed line triangle 25 shown in FIG. 1.

FIG. 3 shows the link pair 10, 20 in a new position having been rotated relative to each other about their center joint. Three dashed lines 34, 36 and 38, are shown passing through paired corner joints 4, 14; 6, 16; and 8, 18, respectively. The angle formed between dashed lines 34 and 36 is the same as the angle formed between dashed lines 24 and 26 shown in FIG. 2. Likewise the angles formed respectively between dashed lines 36, 38 and 38, 34 are the same as those angles formed respectively between dashed lines 26, 28 and 28, 24 shown in FIG. 2. Thus triangle 35 has the same shape as triangle 30 shown in FIG. 2, but larger in size.

Figure 4:
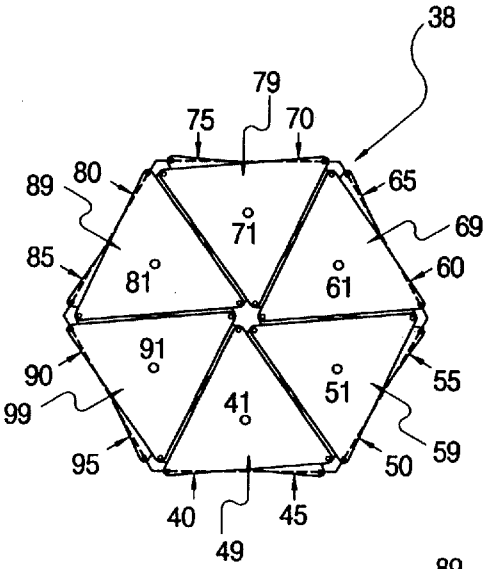

Referring to FIG. 4 the expanding right triangle is extended to an expanding hexagon by forming a loop assembly 38 consisting of 12 polygon links 40, 45, 50, 55, 60, 65, 70, 75, 80, 85, 90 and 95. These polygon links are respectively joined by center joints 41, 51, 61, 71, 81 and 91 into 6 link pairs 49, 59, 69, 79, 89 and 99. The loop assembly 38 is formed by joining the internal corner joint of each top layer to the adjacent internal corner joints of the two adjacent lower polygons on both sides. The internal corner joints are easily seen with reference to FIG. 5.

Figure 5:
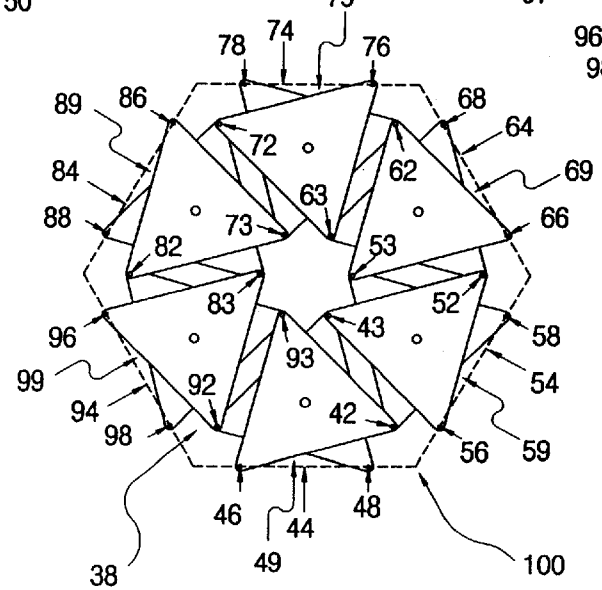

Thus, referring to FIG. 5 loop assembly 38 is shown unfolded into a different position while maintaining the overall hexagon shape defined by edges drawn between the outer joints of each polygon, as discussed below. In this new position, it is more readily noticeable how adjacent polygon links are connected. For example, link pair 49 is connected to link pair 59 by the two corner joints 42 and 43. These corner joints are referred to as internal corner joints since they are located on the interior portion of the loop assembly 39. Likewise link pairs 59 and 69 are connected to each other by internal corner joints 52 and 53. Similarly link pairs 69, 79; 79, 89; 89, 99; and 99, 49 are connected by internal corner joints 62, 63; 72, 73; 82, 83; and 92, 93, respectively.

A dashed line 44 is shown passing through corner joints 46 and 48. These corner joints are located near the outer edge of loop assembly 38 in its unfolded position. These joints are the perimeter corner joints of the loop assembly. Likewise a dashed line 54 is shown passing through perimeter corner joints 56 and 58 and dashed lines 64, 74, 84 and 94 are shown passing through perimeter corner joints 66, 68; 76, 78; 86, 88; and 96, 98, respectively. These dashed lines through the perimeter corner joints define the edges of the expanding hexagon 100, mentioned above.

Figure 6:
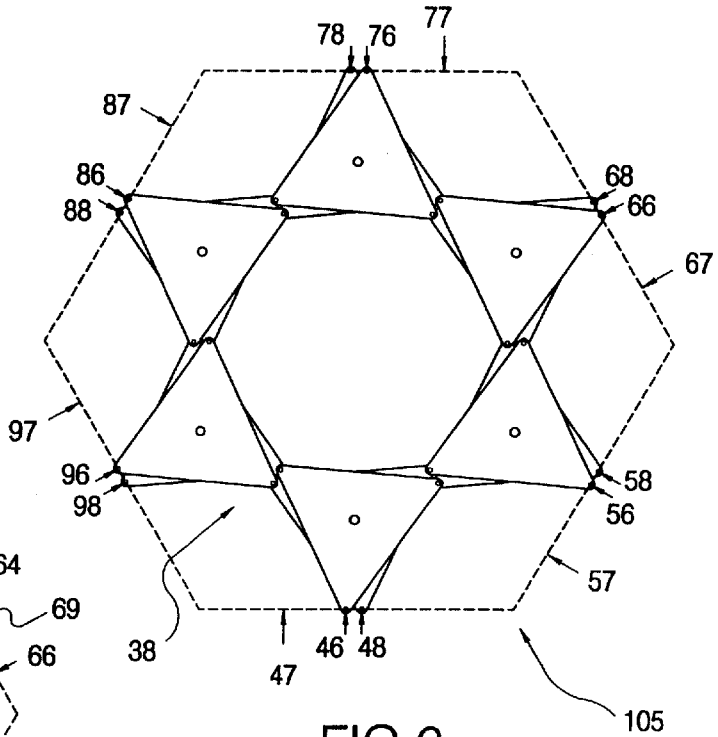
FIGS. 4–6 are plan views of one type of two dimensional loop assembly of polygon links in accordance with the present invention, shown in three positions: retracted, partially expanded and fully expanded, respectively.

Referring to FIG. 6, loop assembly 38 is shown unfolded further, into yet a different position while maintaining the overall hexagonal shape. Dashed lines 47, 57, 67, 77, 87 and 97 are shown passing through perimeter corner joints 46, 48; 56, 58; 66, 68; 76, 78; 86, 88; and 96, 98 respectively, forming hexagon 105. The commonality between hexagons 100 and 105 is that the angle formed between dashed lines 47 and 57 is the same as the angle formed between 44 and 54 shown in FIG. 5. Likewise the angles formed between dashed lines that correspond to any two link pairs as shown in FIG. 6 are identical to those angles similarly formed corresponding to the same two link pairs, as shown in FIG. 5.

Figures 7, 8, 9:
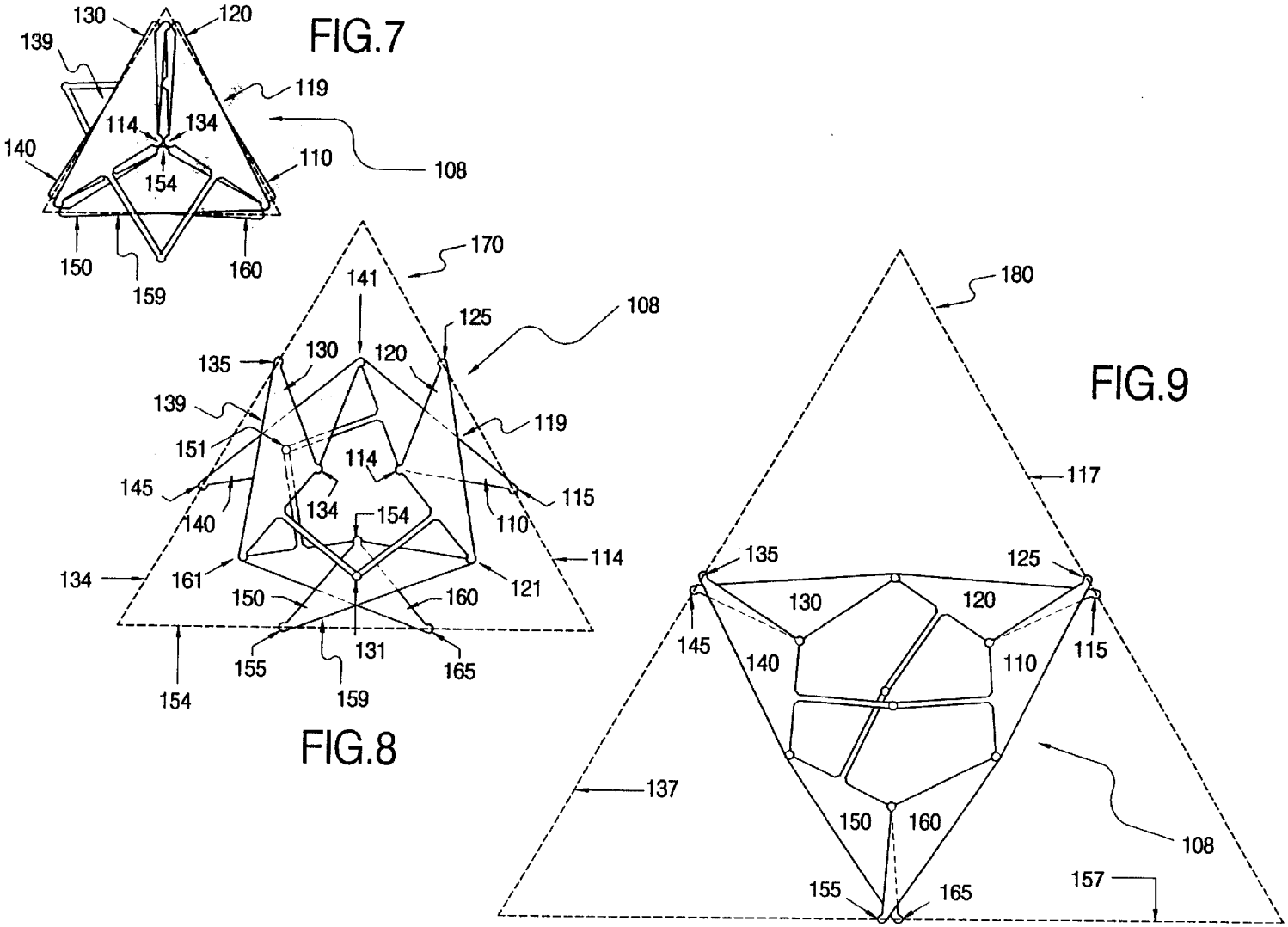
FIGS. 7–9 are plan views of a second type of two dimensional loop assembly of polygon links in accordance with the present invention shown in three positions: retracted, partially expanded and fully expanded, respectively.

Referring now to FIG. 7 a different triangle loop assembly 108 is shown consisting of 6 polygon links 110, 120, 130, 140, 150 and 160. These polygon links are respectively joined by center joints 114, 134 and 154 into three link pairs 119, 139 and 159. Links 110, 120 are joined at 134 to form pair 119. Links 130, 140 are joined at 114 to form pair 139 and links 150 and 160 are joined at 154 to form pair 159. In FIG. 8 loop assembly 108 is shown unfolded into a different position and as with FIGS. 4–6, the overall triangle shape is maintained. Link pair 119 is connected to link pair 139 by internal corner joints 131 and 141, link pair 139 is connected to link pair 159 by internal corner joint 161 and link pair 159 is connected to link pair 119 by internal corner joints 121 and 151.

The triangular ring perimeter outline 170 of the loop assembly as shown in FIG. 8 comprises line segments 114, 134 and 154. Dashed line 114 is shown passing through perimeter corner joints 115 and 125 and dashed lines 134 and 154 are shown passing through perimeter corner joints 135, 145 and 155, 165 respectively.

In FIG. 9 the loop assembly 108 is shown in a further unfolded position. Dashed lines 117, 137 and 157 are shown passing through paired perimeter corner joints 115, 125; 135, 145; and 155, 165 respectively, thereby forming triangular ring 180 which is larger in size than ring 170 of FIG. 8.

The angle formed between dashed line-segments 117, 137 is the same as the angle formed between 114, 134 in FIG. 8. Similarly, the angles formed between dashed lines 137, 157 and lines 157, 117 are the same as those angles formed between lines 134, 154 and lines 154, 114 in FIG. 8.

The loop assemblies shown to this point were all formed by joining adjacent link pairs directly at internal pivot points. The result was a loop assembly with all link pairs lying on parallel planes. It is also possible to add relative dimension to the loop assembly by introducing hub elements between the internal corner pivot joints of adjacent link pairs. As seen in loop assembly 208 of FIG. 10, hub elements such as 299 are used to pivotally connect each link pair to its neighbor. In addition, using hub elements, more than two link pairs can be joined at a single connection point.

Figure 12:
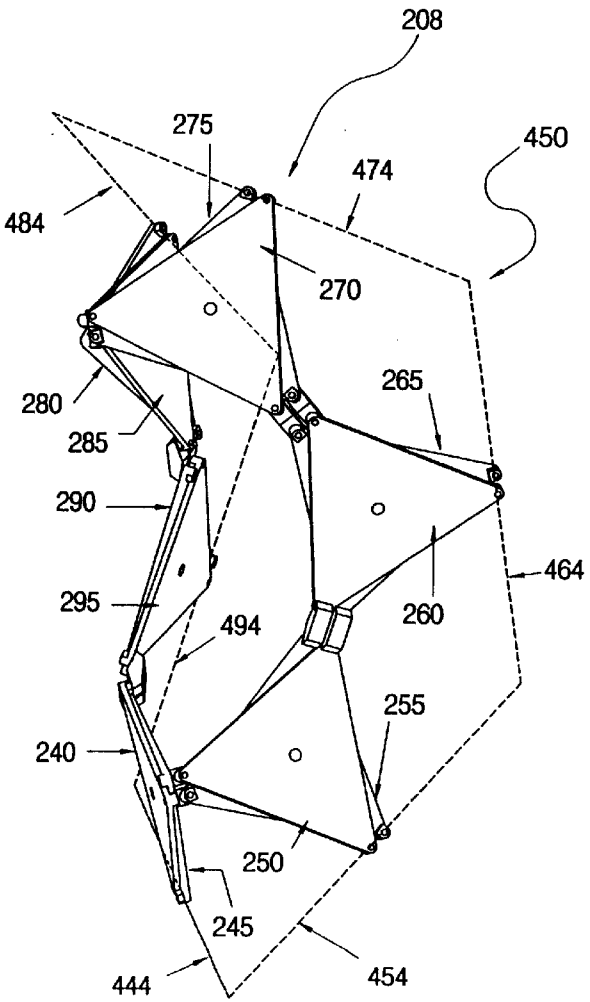
FIGS. 10–12 are perspective views of a three dimensional loop assembly of polygon links in accordance with the present invention, shown in three positions.
Figure 11:
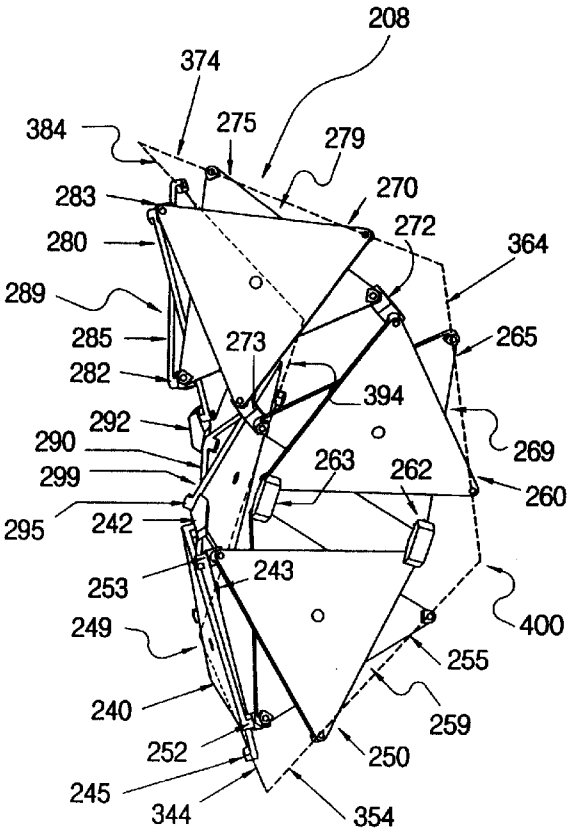
Figure 10:
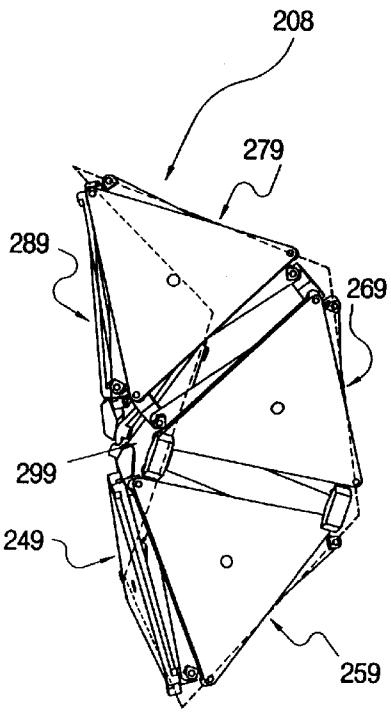

Other than the hub elements, loop assembly 208 is similar to the other loop assemblies discussed above. Indeed, it will be recognized that the loop assembly of FIGS. 10–12 is similar to that of FIGS. 4–6. In FIGS. 4–6 there are no hub elements and the link pairs lie in parallel planes. In FIGS. 10–12 the hub elements position the same link pairs into non parallel planes. Loop assembly 208 contains polygon links and each has three cover joints and one center joint through which they are paired into link pairs, 249, 259, 269, 279, 289 and 299.

A hub element can be any linking material with at least two separate pivot points that are not coaxial with each other. The hub element could have an angle or it could be straight. The axes of the hub pivot points could be parallel, perpendicular or from some other angle therebetween. Each of these variations will impact on the creative design element of the loop assembly including its range of motion.

The size of the hub element and the material chosen for its construction will also impact on the durability of the loop assembly.

FIG. 11 shows loop assembly 208 unfolded into a different position while the lines crossing the perimeter joints of the polygon links maintain the same polygon shape. Link pair 249 may be seen to be pivotally connected to two hub elements 252 and 253 which connect in turn to link pair 259. Likewise link pair 259 is connected to link pair 269 via hub elements 262 and 263. Similarly, link pairs 269, 279; 279, 289; 289, 299; and 299, 249 are successively connected by hub elements 272, 273; 282, 283; 292, 293; and 242, 243, respectively. As explained above, these hub elements introduce angles between the planes of adjacent link pairs.

The dashed lines 344, 354, 364, 374, 384 and 394 lie in the planes of their corresponding link pairs, 349, 359, 369, 379, 389 and 399 respectively, and form a three dimensional ring 400. These lines cross through the perimeter corner joints of their respective links: 240, 245 for link pair 249; 250, 255 for link pair 259; 260, 265 for link pair 269; 270, 275 for link pair 279; 280, 285 for link pair 289; and 290, 295 for link pair 299.

In FIG. 12 the loop 208 is shown further unfolded into a different position. The dashed lines 444, 454, 464, 474, 484 and 494 drawn respectively through the perimeter corner joints of the polygon links 240, 245; 250, 255; 260, 265; 270, 275; 280, 285; and 290, 295. As with the other loop assemblies described above, these line segments form a ring 450 that is larger in size than ring 400 shown in FIG. 11. However, the angle formed between dashed line 444 and 454 is the same as that angle formed between lines 344 and 354 of FIG. 11. Likewise the angles formed between dashed lines that correspond to any two adjacent link pairs as shown in FIG. 12 are identical to those similarly formed angles corresponding to the same two link pairs as shown in FIG. 11. Perimeters may be left open or used to connect to another assembly or polygon link pair.

As described above, loop assemblies formed in accordance with the present invention can be used in forming three dimensional closed structures. In some instances it will be sufficient to connect two or more loop assemblies together. Other cases may require additional link pairs connected to the loop assemblies to close the structure.

Generally, the loop assemblies and/or link pairs are connected together at the perimeter pivot joints described above. It will not always be necessary to use all available perimeter pivot joints. However, the interconnections may only use perimeter corner joints. The interconnections between loop assemblies will generally involve hub elements, although direct pivotal connections are possible, as well as living hinges, as described below.

It is important to note that reference to perimeter corner joints has meaning only with respect to a given loop assembly. Once a structure is assembled the perimeter outline of the loop assembly can be drawn with any arbitrary selection of link pairs due to the symmetry inherent in the structure.

Figure 13:
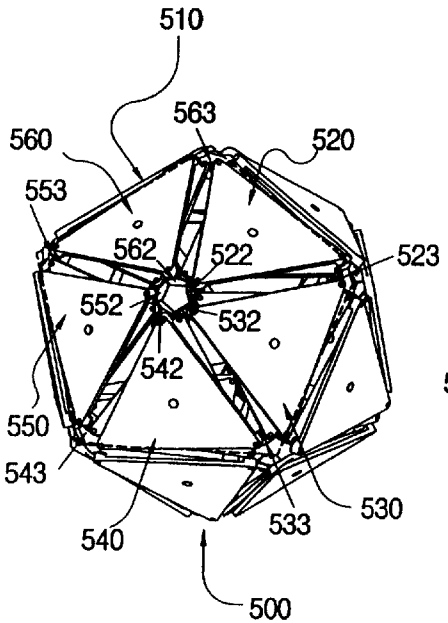

Referring to FIG. 13 a structure 500 is shown in a folded position. Structure 500 consists of 20 link pairs in interlocking loop assemblies, each link pair comprised of two polygon links. One such loop assembly 510, within structure 500, consists of five link pairs 520, 530, 540, 550 and 560. Link pair 520 is pivotally connected to link pair 530 by two hub elements 522 and 523. Similarly link pairs 530, 540, 550, and 560 are successively joined together by hub elements 532, 533; 542, 543; and 552, 553, respectively. Link-pair 560 is connected to link-pair 520 by hub elements 562 and 563. One may recognize that the loop assembly 510 is similar to that shown in FIGS. 10–12 except that only five link pairs are used and the hub elements have different angles.

A structure constructed in accordance with the present invention can include as a creative design element, the formation of a continuous surface. As shown in FIG. 13, in the folded position, structure 500 forms a substantially closed and continuous surface. The degree of continuity will depend on the polygon profile of the links, the number of links in the loop assembly and the angle in the hub elements.

Figure 14:
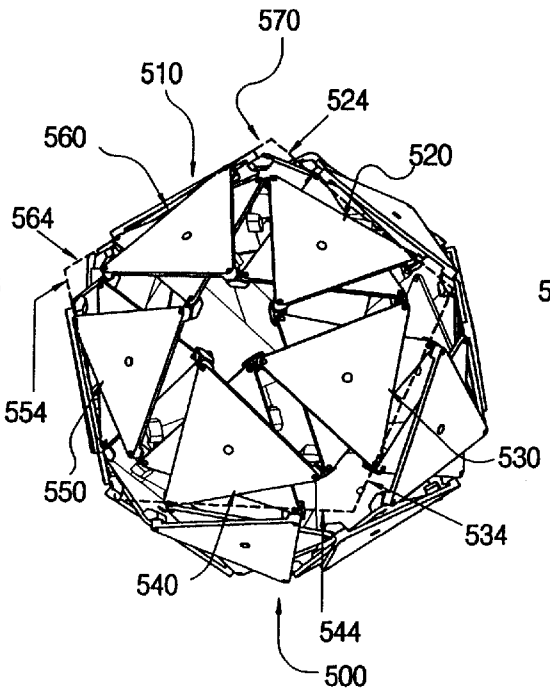

FIG. 14 shows structure 500 unfolded into a larger position. Dashed line 524 passes through the perimeter corner joints of link pair 520. Similarly dashed lines 534, 544, 554 and 564 respectively pass through the perimeter corner joints of link pairs 530, 540, 550 and 560. Dashed line segments 524, 534, 544, 554 and 564 form a five-sided ring 570.

Figure 15:
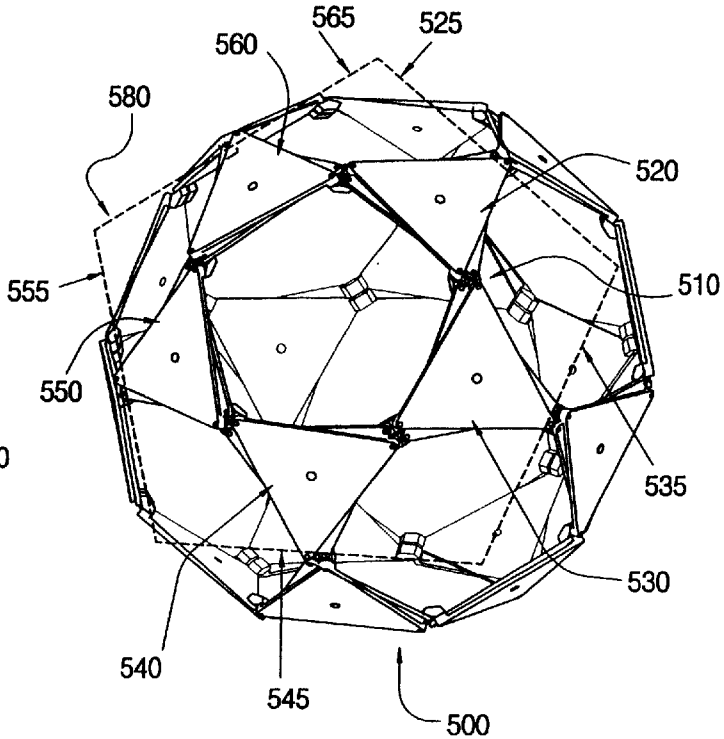
FIGS. 13–15 are perspective views of a three dimensional reversibly expandable structure of polygon links in accordance with the present invention, shown in three positions: retracted, partially expanded and fully expanded, respectively.

In FIG. 15 the structure 500 is again further unfolded. The dashed lines 526, 534, 546, 556 and 566 pass respectively through the perimeter corner joints of link pairs 520, 530, 540, 550 and 560, thus forming a five sided ring 580 which is larger in size than ring 570 in FIG. 14. The angles formed between dashed lines that correspond to any two adjacent link pairs in FIG. 15 are identical to those similarly formed angles corresponding to the same two link pairs in FIG. 14. In its fully unfolded position, another creative design element resulting from the polygon links that make up structure 500 may be seen. Namely the link pairs separate and create openings that are pentagonally shaped.

Figure 16:
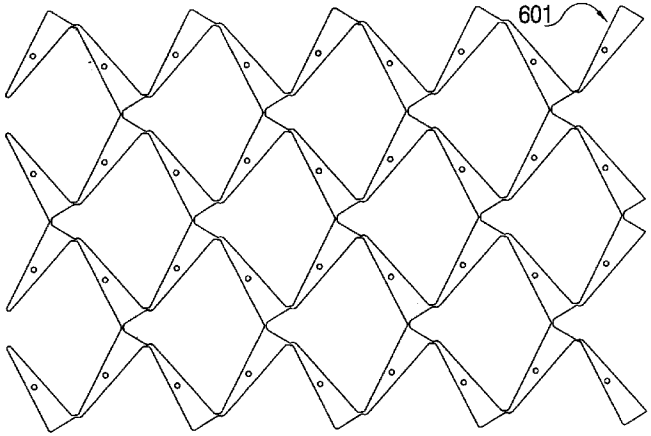
FIG. 16 is a plan view showing an alternate embodiment of a polygon link assembly.

In addition to the simple pivots shown above for the inter-link connections, either hub or direct, connections can also comprise living hinges. A living hinge is a flexible portion of a material, continuous with, and connecting two or more stiff portions of the material. A change in dimension from the stiff portion gives rise to the flexible portion. FIG. 16 shows a sheet of material 601 that consists of triangular stiff regions of material that act as polygon links, which are connected by thinner flexible regions of material that act as corner joints. While many materials are suitable for living hinges to be used in accordance with the present invention, and those skilled in the art will be readily able to determine the same, polypropylene and nitemol are believed to be especially suitable materials for forming living hinges.

Figure 17:
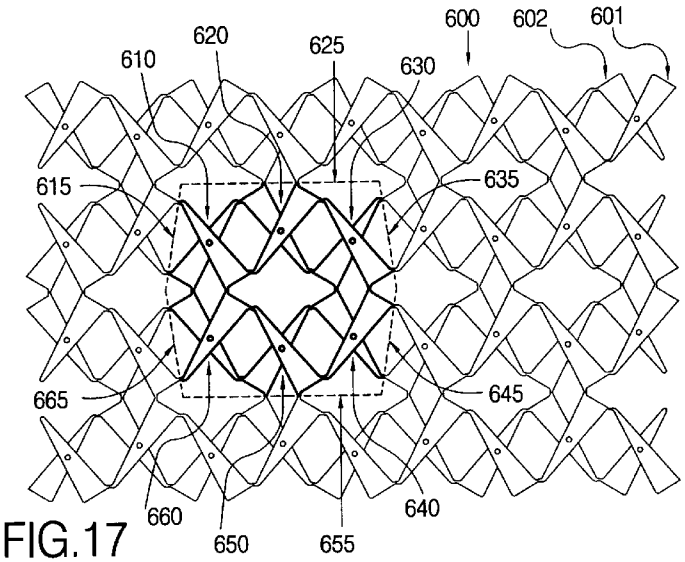
FIGS. 17–19 show plan views of a two dimensional embodiment of the invention using a pair of the polygon link assemblies of FIG. 16, shown in three positions: partially expanded, fully expanded and retracted, respectively.
Figure 19:
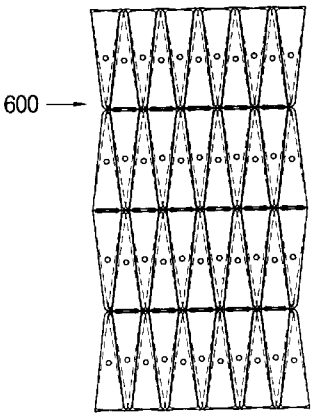

FIG. 17 shows a flat structure 600 which consists of two sheets of material 601 as above, and 602 which is the mirror image of 601. Sheet 601 is joined to sheet 602 by thirty-six pivot joints to create thirty-six link pairs. The folded position of this structure is shown in FIG. 19. These link pairs are arranged in interlocking loop assemblies. One such loop assembly 605 consists of six link pairs 610, 620, 630, 640, 650 and 660. Dashed line 615 passes through the perimeter corner joints of link pair 610. Similarly dashed lines 625, 635, 645, 655 and 665 respectively pass through the perimeter corner joints of link pairs 620, 630, 640, 650 and 660.

Figure 18:
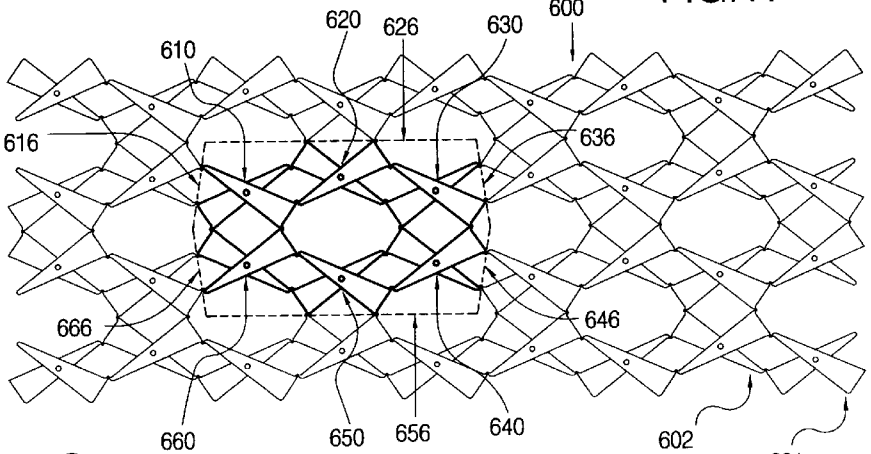

While FIG. 18 shows living hinges used at internal corner pivot joints, it is also possible to use living hinges at the center pivot joint. An example of a link pair with a living hinge center pivot joint is shown below in connection with FIG. 28.

In FIG. 18 the structure 600 is shown unfolded into a larger position. Dashed line 616 passes through the perimeter corner joints of link pair 610. Similarly dashed lines 626, 636, 646, 656 and 666 respectively pass through the perimeter corner joints of link pairs 620, 630, 640, 650 and 660. The angle formed between dashed lines 616 and 626 is identical to the angle formed by dashed lines 615 and 625 shown in FIG. 17, however, unlike the loop assemblies shown in prior FIGS., the shape of the loop assembly changes with folding and unfolding since the size of the edges do not change proportionally. Similarly the angles formed respectively between dashed lines 626, 636; 636, 646; 646, 656; and 656, 666 are identical to those angles formed respectively by dashed lines 625,635; 635,645; 645,655; and 655, 665 shown in FIG. 17.

Figure 20:
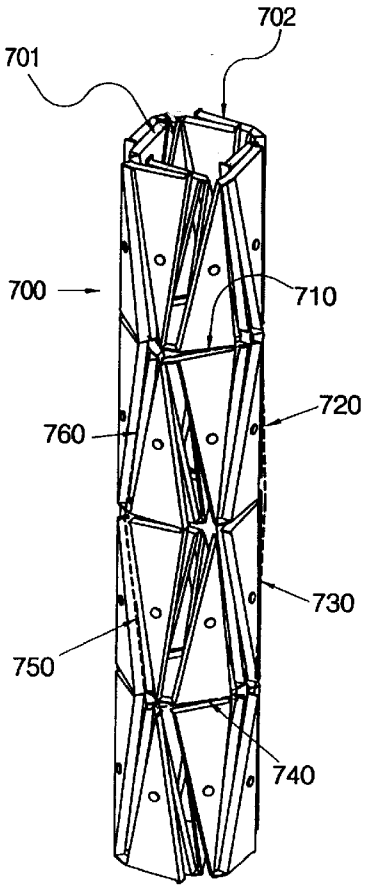

Structure 700 shown in FIG. 20 also consists of two sheets of material 701 and 702. Similar to sheets 601, 602 shown in FIG. 16, sheets 701, 702 are comprised of triangular stiff regions of material acting as polygon links that are connected by thinner flexible regions of material acting as corner joints. Sheets 701 and 702 have been joined together by a plurality of center pivot connections and are formed into a cylindrical shape.

The cylindrical structure can be formed by joining the opposite, parallel edges of a loop assembly much like that of FIGS. 17–19. Alternatively, two cylinders can be formed from a continuous cylindrically shaped material with links cut out much like FIG. 16. One cylinder can be placed over and around a second cylinder joined by center pivot joints. Yet, a third method would be to cut out link pairs from a single cylindrical material with living hinge center pivot joints. Other embodiments will become apparent to those skilled in the art and fall within the scope and spirit of this invention.

In its folded position, the polygon links that make up structure 700 may be seen to form a continuous surface much as described in connection with FIG. 13. Six dashed lines 710, 720, 730, 740, 750 and 760 are shown to pass through the perimeter corner joints of six of the link pairs.

Figure 21:
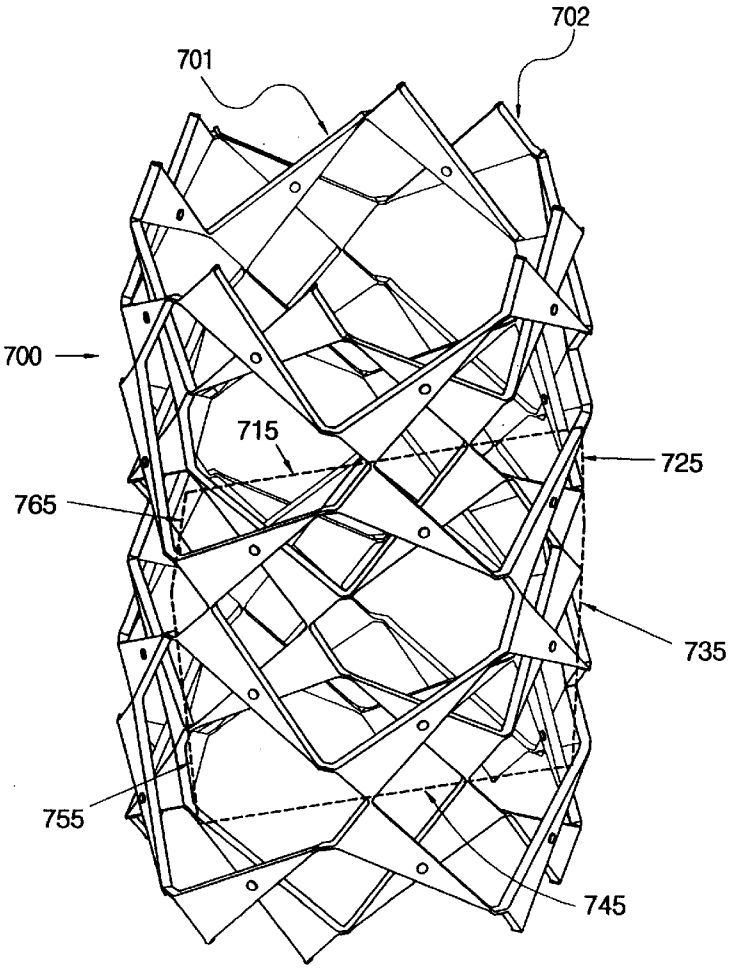
FIGS. 20–21 are perspective views of a cylindrical assembly of polygon links in accordance with the present invention shown retracted and expanded, respectively.

FIG. 21 shows the structure 700 in an unfolded position in which it maintains its overall cylindrical shape. Six dashed lines 715, 725, 735, 745, 755 and 765 pass through the perimeter corner joints of six link pairs. The angle formed between dashed lines 715 and 725 is identical to the angle formed between dashed lines 710 and 720 shown in FIG. 20. Similarly, the angles formed between dashed lines that correspond to any two adjacent link pairs as shown in FIG. 21 are the identical to those similarly formed angles corresponding to the same two link pairs as shown in FIG. 20.

Figure 22:
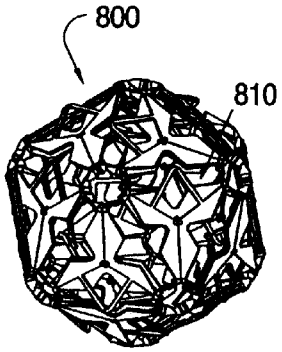

FIG. 22 shows yet another structure 800 comprised of interconnected loop assemblies, in a folded position. This structure is comprised of 20 loop assemblies, one of which is loop assembly 810 which is similar to loop assembly 108 of FIG. 8.

Figure 23:
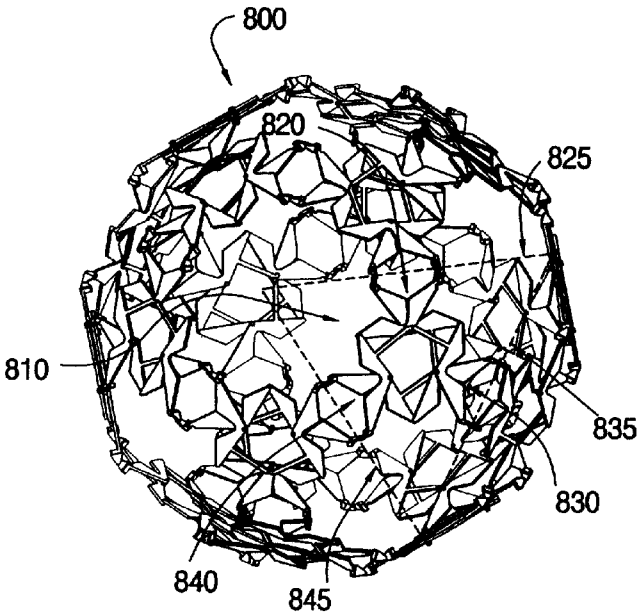

FIG. 23 shows the structure 800 in a partially unfolded position. Loop assembly 810 may be seen to be comprised of three link pairs 820, 830 and 840. Dashed line 825 passes through the perimeter corner joints of link pair 820 while dashed lines 835 and 845 respectively pass through the perimeter corner joints of link pairs 830 and 840.

Figure 24:
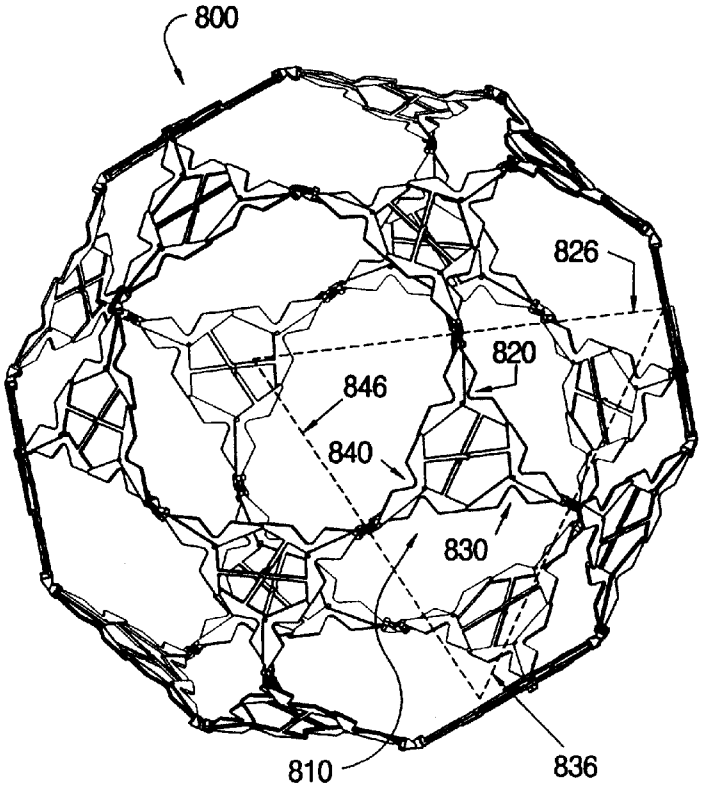
FIGS. 22–24 are perspective views of a three dimensional reversibly expandable structure of the present invention using polygon links, having an icosahedral shape and shown in three positions: retracted, partially expanded and fully expanded, respectively.

FIG. 24 shows structure 800 in a fully unfolded position, with dashed line 826 passing through the perimeter corner joints of link pair 820 and dashed lines 836 and 846 respectively passing through the perimeter corner joints of link pairs 830 and 840. The angle formed between dashed lines 826 and 836 is identical to the angle formed by dashed lines 825 and 835 shown in FIG. 23. Likewise the angles formed between the other adjacent dashed lines shown in FIG. 24 are identical to those similarly formed angles shown in FIG. 23.

Figure 25C:
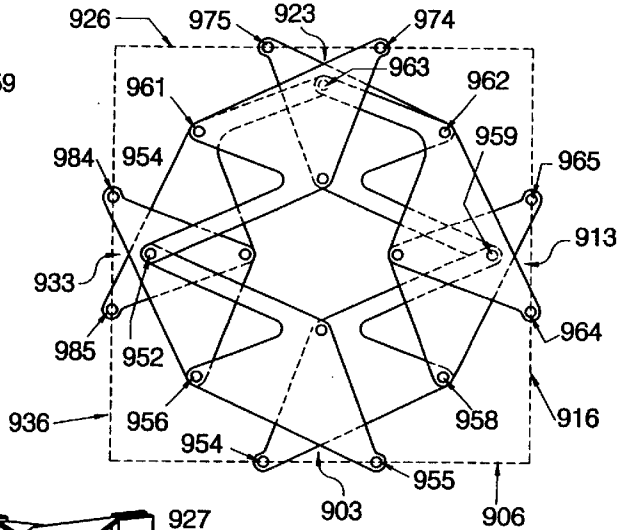
FIG. 25C shows a loop assembly.
Figure 25B:
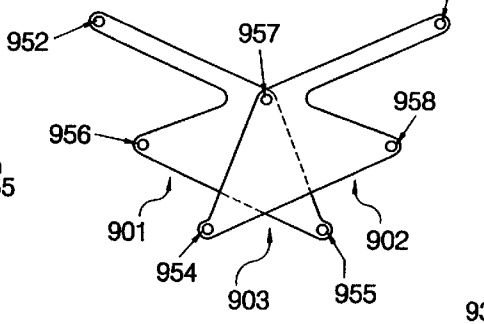
FIG. 25B shows a link pair.
Figure 25A:
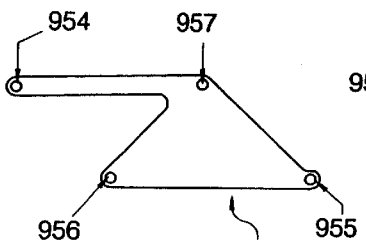
FIG. 25A shows a polygon link.

FIG. 25A shows a polygon link 901, which has a center pivot joint 957, two interior pivot joints 954 and 956, and a perimeter pivot joint 955.

FIG. 25B shows a link pair 903 consisting of two polygon links 901 and 902 which share the center pivot joint 957. Also shown are the interior pivot joints for polygon links 901 and 902, respectively 952, 956, 958 and 959. Finally, the perimeter pivot joints for 902 and 903 are shown, being respectively 954 and 955.

FIG. 25C shows a loop assembly 910 in a partially unfolded position. Loop assembly 910 consists of four link-pairs 903, 913, 923 and 933, each link-pair comprised of two polygon links. A dashed line 906 passes through perimeter joints 954 and 955 which belong to link-pair 903. Similarly dashed lines 916, 926 and 936 pass through perimeter joints 964, 965 and 974, 975 and 984, 985 respectively, forming a four-sided shape.

Loop-assembly 910 (FIG. 26) shows an alternative arrangement for the connection of link-pairs to one another. Rather than all interior corner-joint connections being made between adjacent link-pairs, some interior corner joints are connected to link-pairs that are non-adjacent.

Specifically, link-pair 903 (FIG. 27) is connected to adjacent link-pair 913 by its interior corner joint 958, and likewise to adjacent link-pair 933 by interior corner joint 956. However, in addition link-pair 903 is connected to non-adjacent link-pair 923 by two interior corner-joints 952 and 959.

Figure 26:
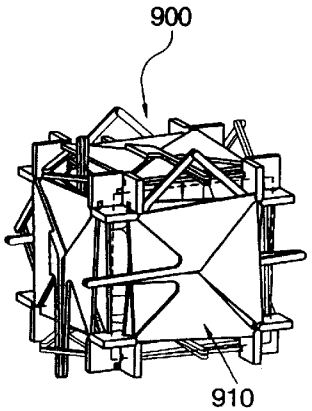
FIG. 26 shows the structure 900 in a folded position.

FIG. 26 shows the structure 900 in a folded position. This structure is comprised of 6 loop-assemblies, one of which is loop-assembly 910.

Figure 27:
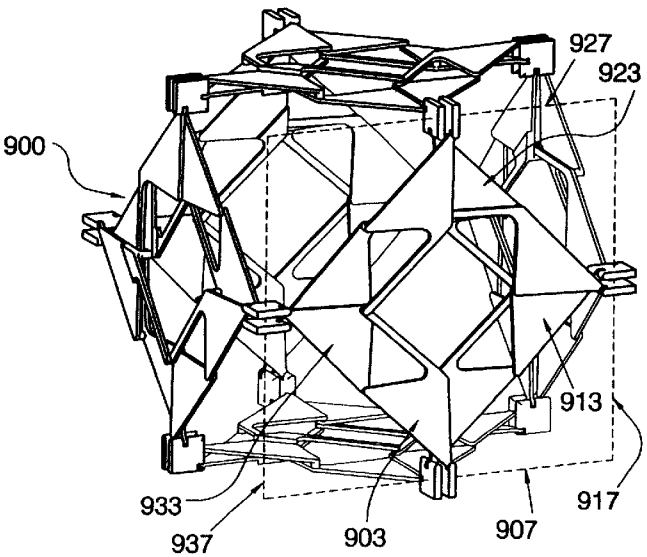
FIG. 27 shows the structure 900 in a fully unfolded position.

FIG. 27 shows the structure 900 in a fully unfolded position. Dashed line 907 passes through the perimeter corner-joints of link-pair 903. Likewise dashed line 917, 927 and 937 respectively pass through the perimeter corner-joints of link-pairs 913, 923 and 933. The angle formed between dashed lines 907 and 917 is identical to the angle formed by dashed lines 906 and 916 shown in FIG. 25C. Similarly, the angles formed between dashed lines that correspond to any two adjacent link-pairs as shown in FIG. 27 are identical to those similarly formed angles corresponding to the same two link-pairs as shown in FIG. 25C.

Figures 28, 29, 30, 31:
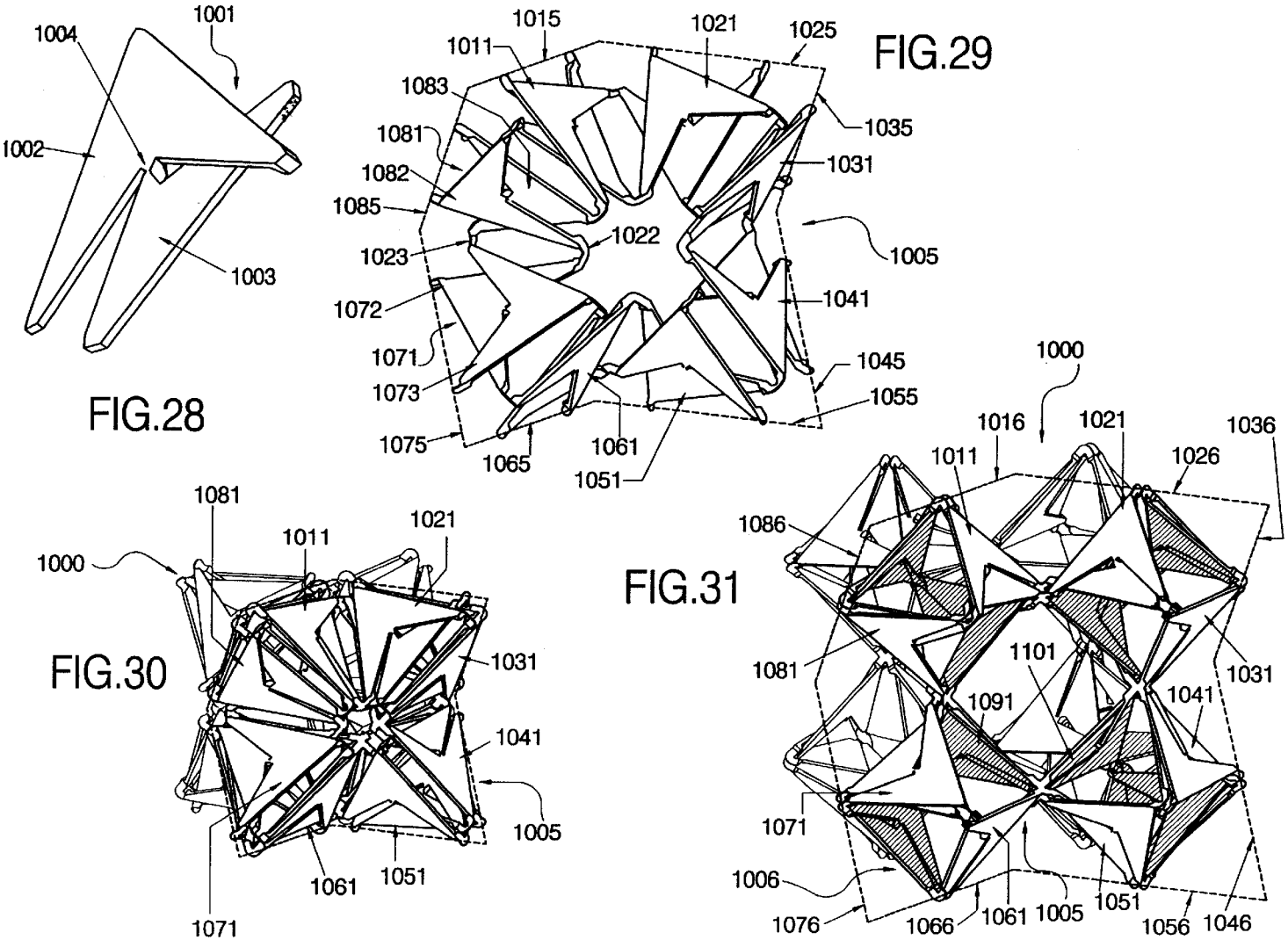
FIG. 28 shows a link pair comprised of a single piece of material.
FIG. 29 shows a loop assembly consisting of eight link pairs.
FIG. 30 shows a structure 1000 consisting of thirty-two polygon link pairs.
FIG. 31 shows structure 1000 in a fully unfolded position.

FIG. 28 shows a link-pair 1001 that is comprised of a single piece of material, cut to form two polygon links 1002 and 1003. Center-joint 1004 is comprised of a region of flexible material which is formed in a continuous manner with links 1003 and 1004. Thus link 1003 can rotate relative to link 1004 by flexing the center-joint 1004.

In FIG. 29 is shown the loop assembly 1005 consisting of eight link pairs 1011, 1021, 1031, 1041, 1051, 1061, 1071 and 1081. Similar to link-pair 1001 shown in FIG. 28, each link pair is formed of two polygon links that are connected by a center-joint comprised of a flexible region of material formed continuously with the polygon links.

Link-pair 1071 is connected to adjacent link-pair 1081 by two interior corner-joints 1022 and 1023. Joint 1022 is comprised of a region of flexible material that is formed continuously with links 1072 and 1082. Likewise joint 1023 is formed continuously with 1073 and 1083.

Thus loop-assembly 1005 is formed from a unitary piece of material comprised of essentially rigid regions acting as polygon links and flexible regions acting as pivot connections.

Also shown in FIG. 29 is a dashed line 1015 which passes through the perimeter corner joints of link-pair 1011. Similarly dashed lines 1025, 1035, 1045, 1055, 1065, 1075 and 1085 respectively pass through the perimeter corner joint of link pairs 1011, 1021, 1031, 1041, 1051, 1061, 1071 and 1081, forming an eight-sided ring of dashed lines.

In FIG. 30 shown structure 1000 consisting of thirty-two polygon link-pairs, each link-pair being similar to link pair 1001 of FIG. 28. These link pairs are grouped as four assemblies of eight link pairs each. One of these loop assemblies of structure 1000 is loop assembly 1005 in its fully folded position.

Structure 1000 is formed of a unitary piece of material consisting of stiff regions acting as polygon-links and relatively flexible regions acting as corner-joints or center-joints.

In FIG. 31 the structure 1000 is shown in a fully unfolded position with dashed line 1016 passing through the two perimeter corner-joints of link-pair 1011. Similarly dashed lines 1026, 1036, 1046, 1056, 1066, 1076 and 1086 may be seen to pass through the perimeter corner-joints of link-pairs lines 1021, 1031, 1041, 1051, 1061, 1071 and 1081 respectively. The perimeter corner joints of loop assembly 1005 are living hinge joints which joint it to adjacent loop-assembly 1006 (shown as a shaded region).

The angle formed between dashed lines 1016 and 1026 is identical to the angle formed between dashed lines 1015 and 1025 shown in FIG. 29. Likewise the angles respectively formed between each dashed line and its neighbor in FIG. 31 is identical to the angles respectively formed between dashed lines shown in FIG. 30.

The interior corner-joints of link-pair 1051 may be seen to be pivotally joined to the interior corner-joints of adjacent link pair 1061. Additionally, the interior corner joints are joined to link pairs 1091 and 1101 which belong to adjacent loop assembly 1006, which is shown in the shaded portion of FIG. 31. Thus each polygon link belonging to link pairs 1051, 1061, 1091 and 1101 is joined to three other polygon links. Similar multiple connections between polygon-links in structure 1000 thus form a three-dimensional matrix of link-pairs.

Figure 32:
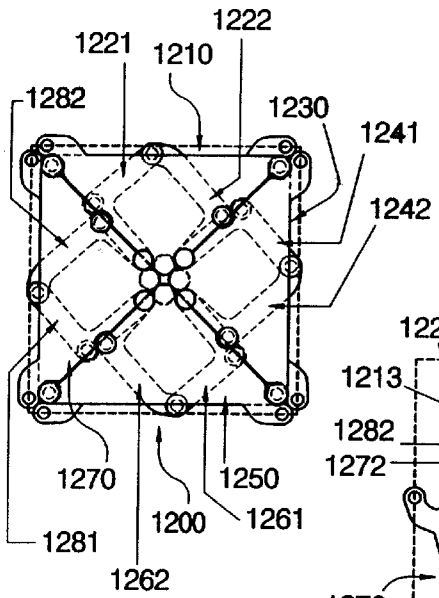

FIG. 32 shows a loop assembly 1200 in a folded position. Loop assembly 1200 is made up in part of four link pairs 1210, 1230, 1250 and 1270. In addition to these four link pairs, 1200 contains eight connecting links 1221, 1222, 1241, 1242, 1261, 1262, 1281 and 1282.

Figure 33:
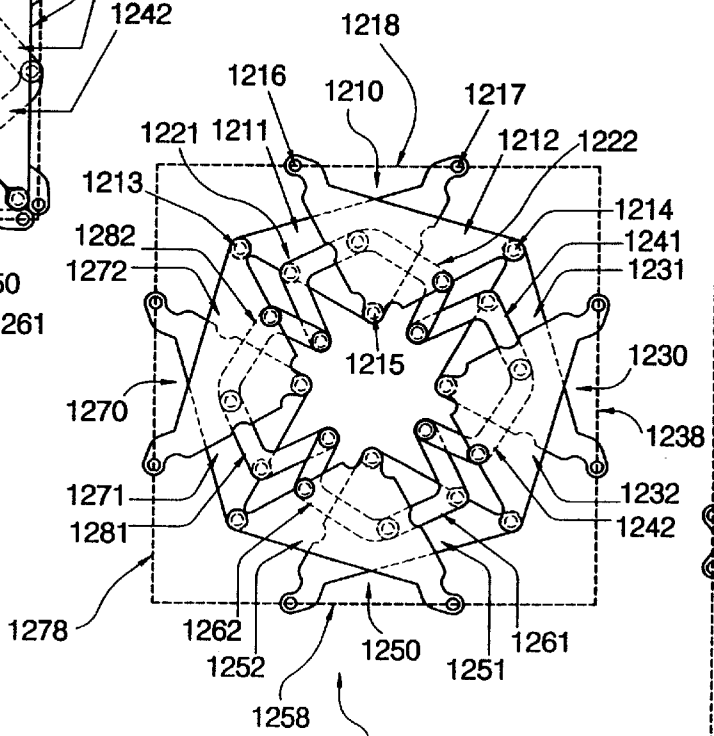

FIG. 33 shows loop assembly 1200 in a partially unfolded position. Link pair 1210 is comprised of two polygon links 1211 and 1212 which are connected by center joint 1215. Link 1211 has an interior corner joint 1213 connecting it to polygon link 1272, and link 1212 is connected to link 1231 by corner joint 1214. Similarly, link-pairs 1230, 1250 and 1270 are connected one to the other via their respective interior corner joints.

In addition to said interior corner joint connections, the four link pair that comprise 1200 are connected one to the other via eight additional connecting links. In particular, link pair 1210 is connected to link pair 1270 by connecting links 1221 and 1282, which are pivotally attached to one another. Similarly, link pair 1270 is connected to 1250 by links 1281 and 1262. Link pairs 1250, 1230 and 1230, 1210 are connected respectively by connecting links 1261, 1242 and 1241, 1222. In addition to these four connections, connecting link 1221 may be seen to be pivotally attached to 1222. Likewise, 1241, 1242 and 1261, 1262 and 1281, 1282 are pivotally attached to one another. Thus the eight connecting links form a closed loop that is pivotally connected in eight places to the four link pairs. Each connecting link has one pivotal connection to one polygon link, each connection link has one center joint and two terminal joints, and is pivotally connected to its neighboring connecting link via one of its terminal joints to form a closed loop.

These eight connecting links serve to synchronize the motion of the loop assembly. This is sometimes necessary in the case where polygon links are connected to one another by only a single interior corner joint, as is true for loop assembly 1200.

Dashed line 1218 passes through perimeter joints 1216 and 1217 which belong to link pair 1210. Similarly dashed lines 1238, 1258 and 1278 pass through the perimeter joints of link pairs 1230, 1250 and 1270 respectively.

Figure 34:
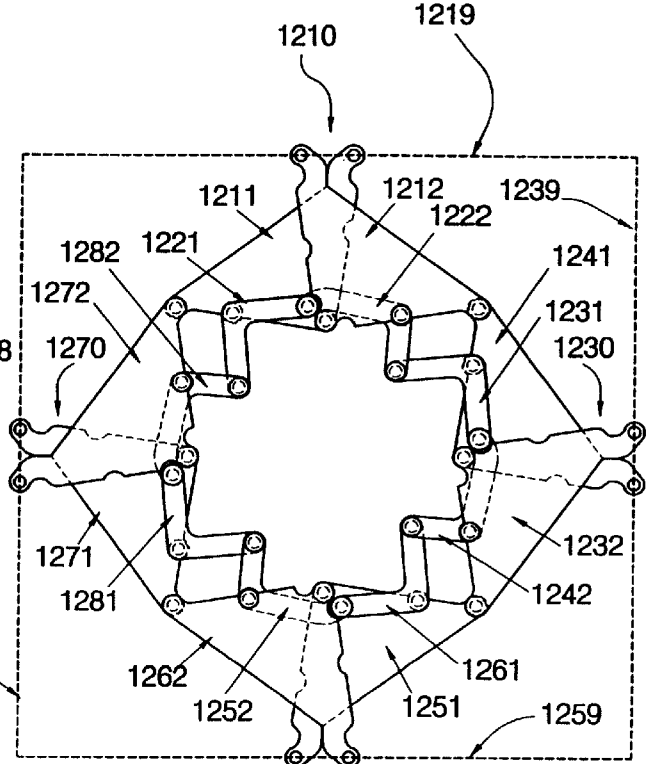
FIGS. 32–34 shows a loop assembly 1200 in a folded position, a partially unfolded position and in a fully unfolded position, respectively.

FIG. 34 shows 1200 in a fully unfolded position. Dashed lines 1219, 1239, 1259 and 1279 pass through the perimeter joints of link pairs 1230, 1250 and 1270 respectively. The angle formed between dashed lines 1219 and 1239 is the same as that formed between 1218 and 1238 shown in FIG. 33. This similarity of angles holds for the other dashed lines as well.

Figure 35B:
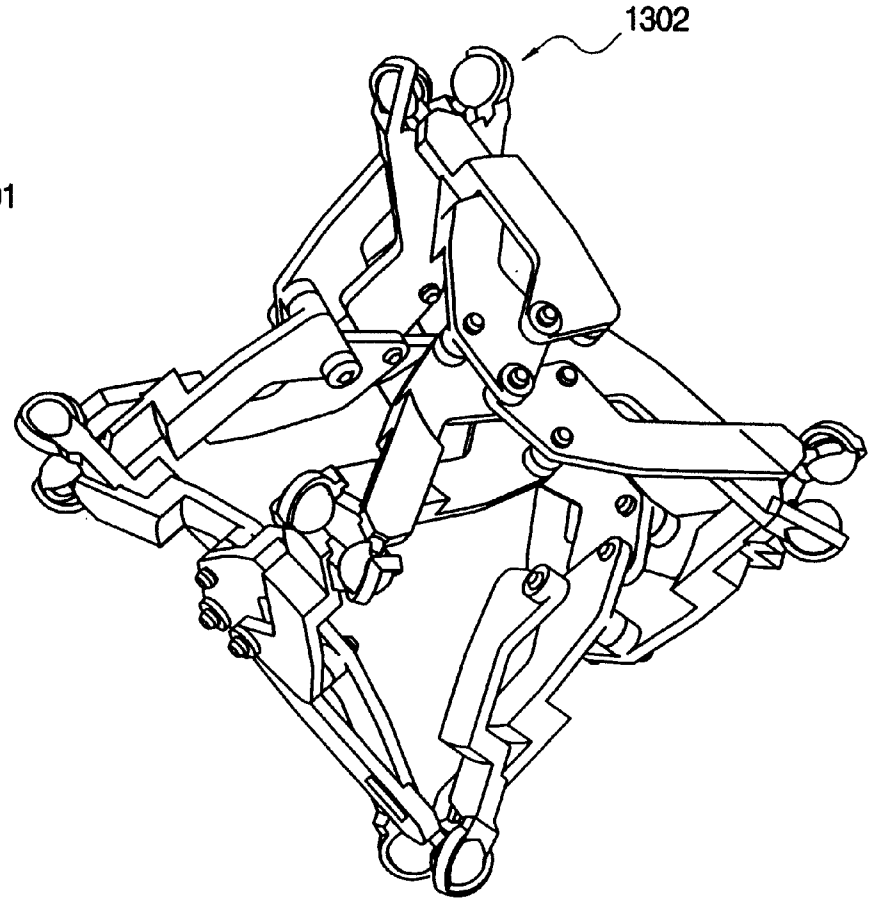
FIGS. 35A and 35B show an alternative embodiment in which separate hub elements are replaced with a ball and socket arrangement.
Figure 35A:
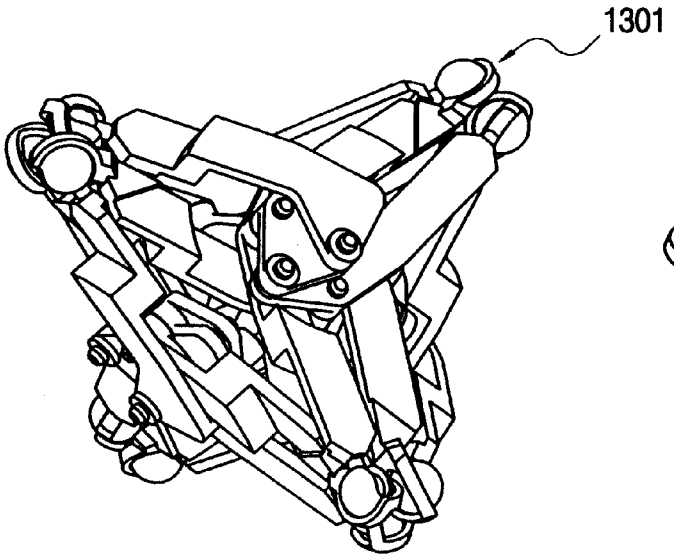

FIGS. 35A and 35B show four triangular loop assemblies with the assembly shown in 35A being folded and the assembly shown in 35B being unfolded. In this embodiment, the connection between loop assemblies includes separate hub elements, shown at 1301 and 1302, which connect adjacent assemblies with the perimeter joint of each polygon link being either a ball or a socket. This embodiment allows loop assemblies to be connected directly without the need of a separate hub element. This particular embodiment provides a reduction of part count (i.e., no hub elements) and favorable structural characteristics as forces between assemblies are transferred directly, rather than indirectly.

Figure 36:
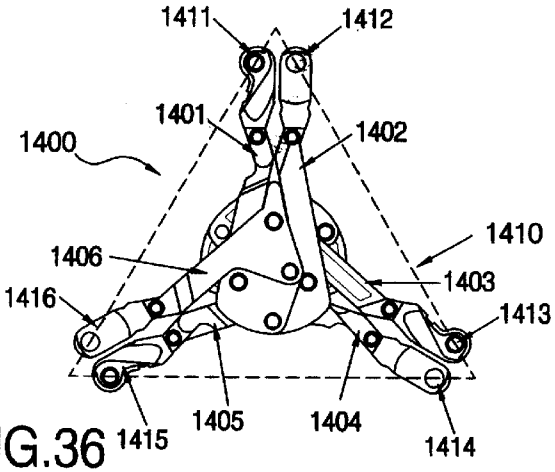

FIG. 36 shows a triangular loop assembly 1400, comprised of polygon links 1401, 1402, 1403, 1404, 1405 and 1406. Perimeter corner joint 1411 is a separate element that is pivotally connected to link 1401. The axis of this pivot connection lies essentially within the plane of link 1401. Similarly, perimeter corner joints 1412, 1413, 1414, 1415 and 1416 are pivotally connected to polygon links 1402, 1403, 1405 and 1406 respectively, each of their axes lying within the plane of their corresponding link. Dashed line 1410 passes through the six perimeter corner joints.

Figure 37:
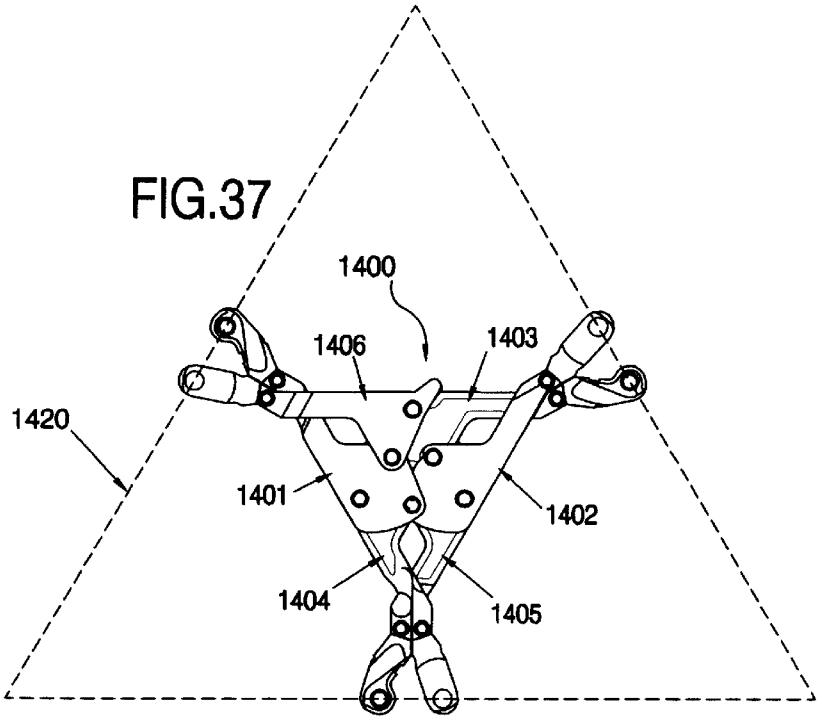
FIGS. 36–37 show front views of an alternate embodiment of the invention, a triangle loop assembly having perimeter corner pivots that are themselves pivotally connected to polygon links.

FIG. 37 shows loop assembly 1400 in its opened state. Dashed line 1420, which passes through all six perimeter corner joints, contains similar angles to those in dashed line 1410.

Figure 39:
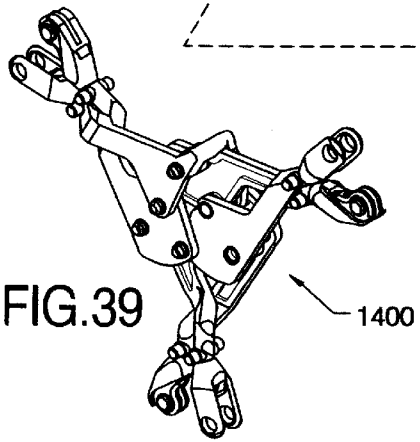
FIGS. 38–39 show perspective views of this embodiment of the invention in its closed and opened states.
Figure 38:
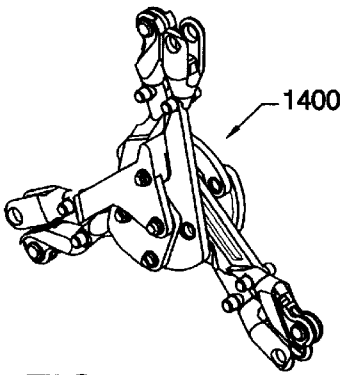

FIGS. 38 and 39 show perspective views of 1400 in its folded and unfolded state.

Figure 40:
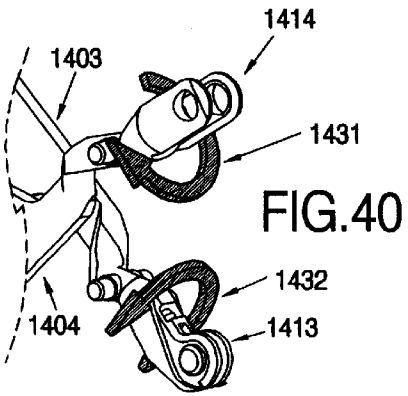
FIG. 40 shows a detail of the perimeter corner joints.

FIG. 40 shows a perspective view of links 1403, 1404 with their corresponding perimeter corner joint 1413, 1414. Corner joint 1413 has a pivotal connection to 1403 whose axis lies essentially within the plane of link 1403. Thus, corner joint 1413 may rotate as indicated by arrow 1432. Corner joint 1414 is pivotally connected to link 1404 in a similar fashion, and rotate as indicated by arrow 1431.

Figure 41:
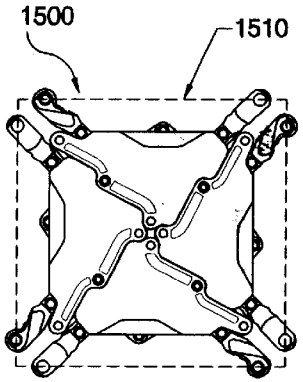
FIGS. 41–42 show front views of a square loop assembly in its closed and unfolded states.
Figure 42:
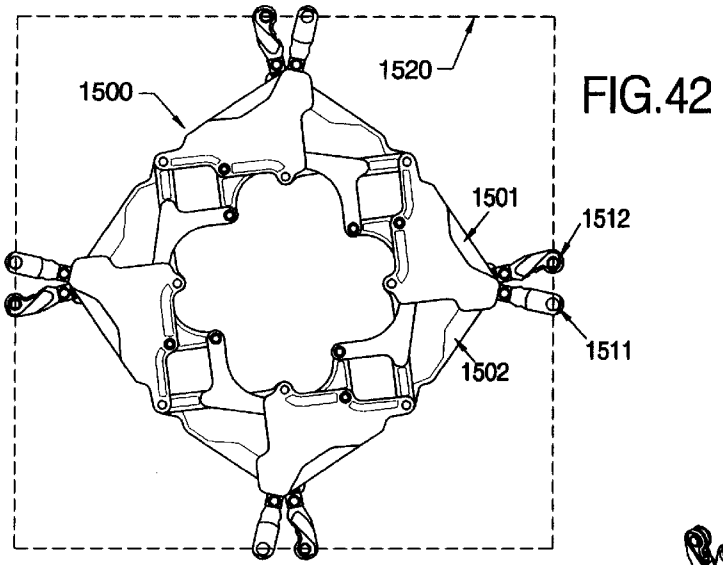

FIGS. 41 and 42 show another embodiment of the invention, a square loop assembly 1500, in its folded and unfolded state respectively. Similar to loop assembly 1200 shown in FIGS. 32–34, assembly 1500 is comprised of eight polygon links, as well as eight additional connecting links.

In FIG. 42 are shown perimeter corner joints 1511 and 1512, which are pivotally connected to polygon links 1501 and 1502 respectively. The axes of said pivots lie essentially within the plane of these two polygon links.

Also shown in FIGS. 41 and 42 are dashed lines 1510 and 1520 respectively, which pass through the perimeter corner joints of loop assembly 1500. Lines 1510 and 1520 contain similar angles to each other.

Figure 43:
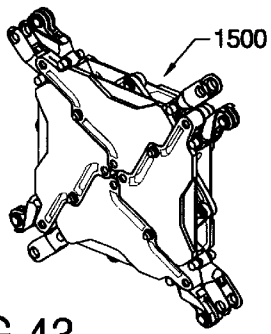
FIGS. 43–44 show perspective views of the square loop assembly.
Figure 44:
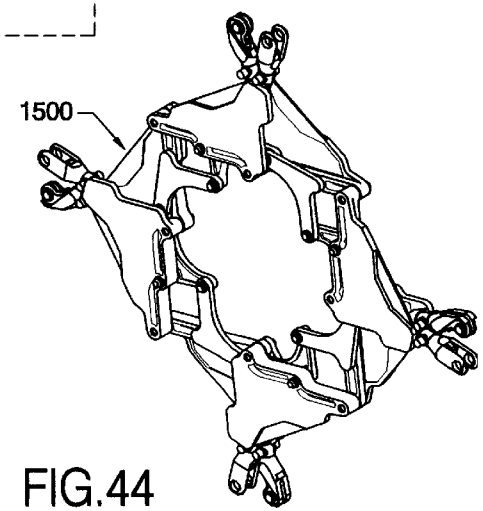

FIGS. 43 and 44 show perspective views of 1500 in its folded and unfolded state.

FIGS. 45 through 50 show how loop assemblies 1400 and 1500 may function as elements of a kit for building reversibly expandable structures. In FIG. 45, loop assembly 1400 is placed adjacent to loop assembly 1500, such that corner joint 1413 is proximate to corner joint 1511. Similarly, joint 1414 is proximate to 1512.

FIG. 46 shows corner joint 1414 being pressed over corner joint 1512. As joint 1414 is pressed, two flexible regions 1415, 1416 spread apart, while two flexible regions 1515, 1516 of joint 1512 are pressed together.

FIG. 47 shows corner joints 1414 and 1512 having been brought into alignment and joined together, the flexible of both joints having snapped back into their unrestrained condition. Joints 1414 and 1512 may now rotate relative to one another as indicated by arrow 1622. This combination of perimeter corner joints 1414 and 1512 having been connected together may now be considered to form a combined hub element 1650. Said hub element has three intersecting axes of rotation indicated by arrows 1621, 1622, 1623 and acts essentially as a ball joint with regards to its range of motion.

FIG. 48 shows loop assemblies 1400 and 1500 having been connected, where corner joints 1511 and 1512 are respectively attached to joints 1413 and 1414, thereby forming combined hub elements 1650, 1651 respectively. Loop assembly 1400 is free to pivot relative to loop assembly 1500 as indicated by arrow 1620.

FIG. 49 shows loop assembly 1400 having been rotated relative to loop assembly 1500 thereby introducing an angle between the planes of each loop assembly. Combined hub elements 1650, 1651 may be squeezed towards each other as indicated by arrows 1630 and 1640.

FIG. 50 shows loop assemblies 1400 and 1500 in an expanded condition after combined hub elements 1650, 1651 have been squeezed together.

Figure 51:
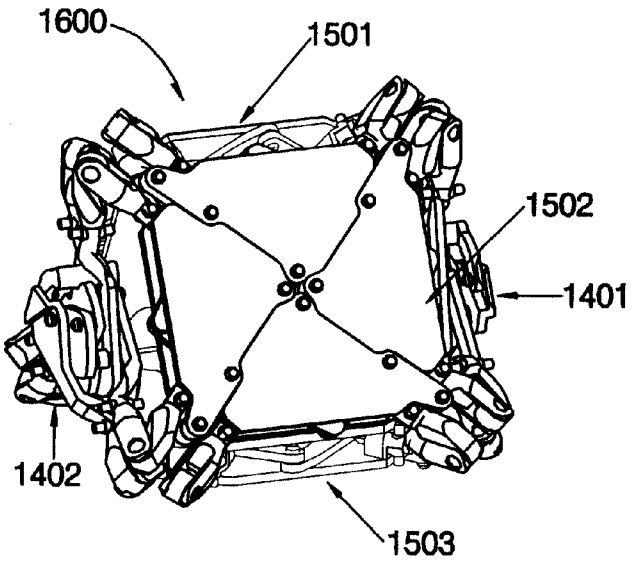

In FIG. 51 are shown two triangle-shaped loop assemblies 1401, 1402 which are connected by their perimeter corner joints to three square-shaped loop assemblies 1501, 1502, 1503 to form a prism-shaped structure 1600. Structure 1600 is shown in its folded state in FIG. 44.

Figure 52:
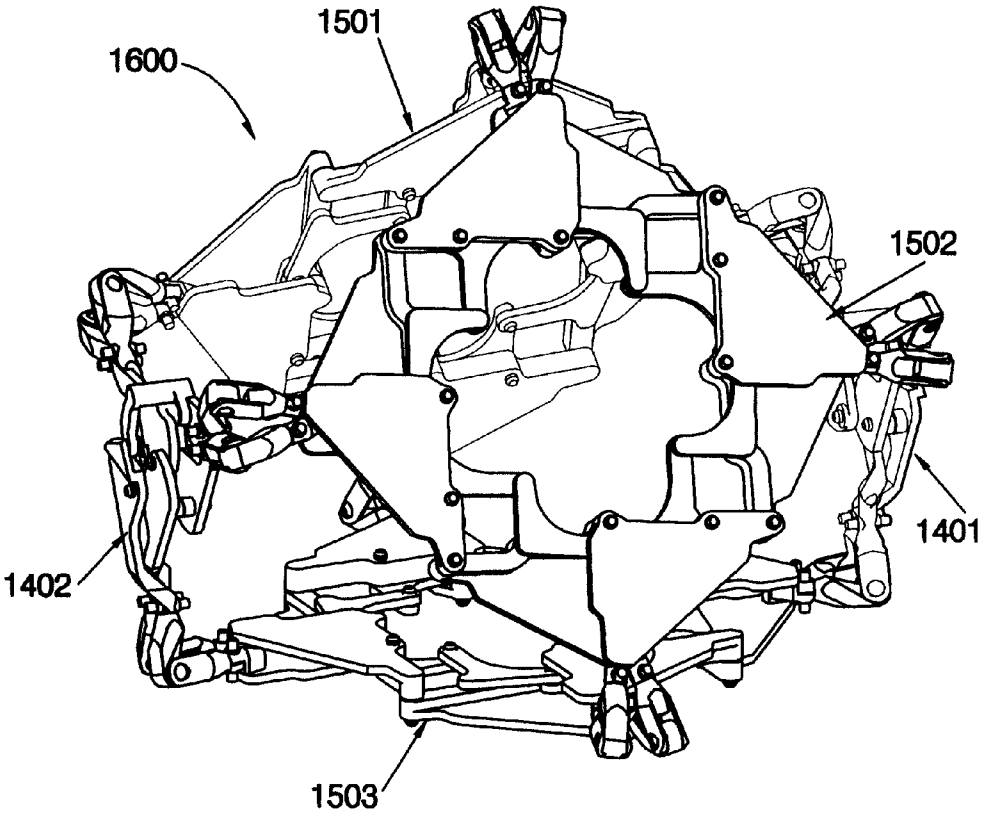
FIGS. 51–52 show a prism-shaped structure in its closed and opened state.

FIG. 52 shows structure 1600 in its unfolded state.

FIG. 53 shows scissor-paid 1700 comprised of two links 1731 and 1732 which are pivotally connected together, said pivot lying in a central region of each link. Terminal pivots 1710 and 1711 are themselves pivotally connected to link 1732; terminal pivots 1720 and 1721 are pivotally connected to link 1731. All end-joints are free to pivot around axes that lie within the plane of scissor-pair 1700.

FIG. 54 shows a perspective view of scissor-pair 1700, where arrows 1725 and 1726 indicate the axis of rotation of end-joints 1710 and 1720 respectively.

FIG. 55 shows prism-shaped structure 1750 in its folded position. Structure 1750 is comprised of three square-shaped loop assemblies 1501, 1502, 1503; two triangle-shaped assemblies 1401, 1402; and six scissor-pairs 1700, 1701, 1702, 1703, 1704 and 1705. Loop assembly 1402 is attached at two points each to three scissor-pairs 1700, 1701, 1702, which are in turn attached to two points each of three loop assemblies 1501, 1502 and 1503. Likewise, loop assembly 1401 is attached at two points each to scissor-pairs 1703, 1704, 1705, which are in turn attached to two pints each of loop assemblies 1501, 1502 and 1503.

In FIG. 56, structure 1750 is shown in its unfolded state. It may be seen that addition of scissor-pairs augment the increase in size of structure 1750 relative to structure 1600 as shown in its unfolded state in FIG. 52.

Figure 57:
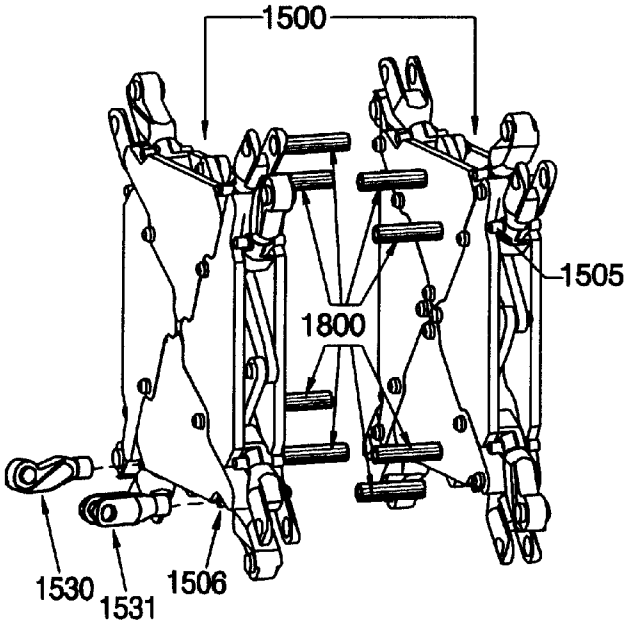

FIG. 57 shows two adjacent square loop assemblies 1501, 1502, such that the planes that each assembly lies in are parallel to one another. Shown between assemblies 1501, 1502 are eight tube elements 1800. Said tube elements may be attached to assemblies 1501, 1502 by pressing them over features in the assemblies such as the post 1505.

Also shown in FIG. 57 are two separate hub elements 1530, 1531, which may be attached to loop assembly 1501 by pressing them over features such as post 1506.

Figure 58:
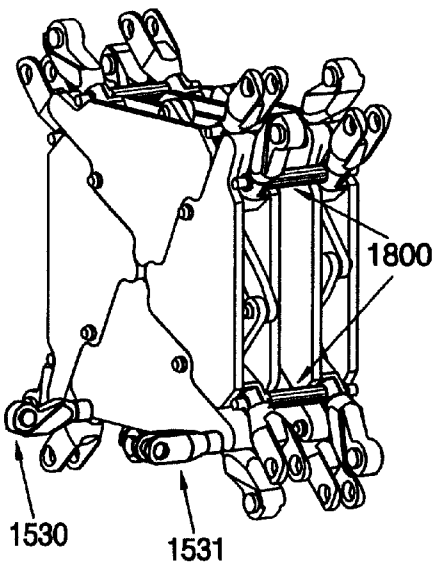

In FIG. 58, loop assemblies 1501, 1502 are shown attached to one another via the eight tube elements 1800 so that each of the eight polygon link pairs in assembly 1501 are connected to a corresponding polygon link pair in assembly 1502. The two loop assemblies are parallel to one another, thereby forming a stacked arrangement.

Also shown in FIG. 58 are separate hub elements 1530, 1531 attached to assembly 1501, thereby providing additional connecting points to the loop assembly.

Figure 59:
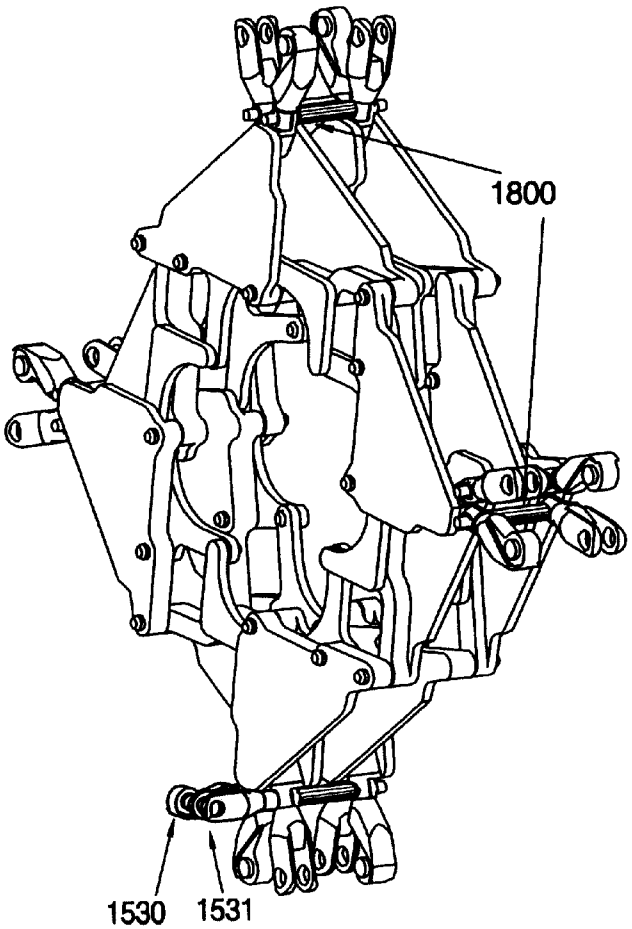
FIGS. 57–59 show means to attach two loop assemblies in a stacked arrangement, and further shows means to attach separate hub elements onto loop assemblies to provide extra attachment points.

FIG. 59 shows loop assemblies 1501, 1502 in an unfolded state, tube elements 1800 serving to synchronize the motion of the two assemblies.

It will be appreciated that the instant specification and claims set forth by way of illustration and not limitation, and that various modifications and changes may be made without departing from the spirit and scope of the present inventions.

What is claimed is:

1. A reversibly expandable loop assembly comprising:

a plurality of links having a polygonal profile with three or more corners, a center pivot joint and a plurality of corner pivot joints, each of at least two of said plurality of corner pivot joints proximate to at least two of said three or more corners, respectively, said plurality of corner pivot joints comprising at least one internal corner pivot joint and at least one perimeter corner pivot joint proximately located to the outer edge of said loop assembly;

each of said plurality of links connected to another one of said plurality of links at said center pivot joint thereby forming a link pair, said loop assembly comprising at least three link pairs;

each of said at least three link pairs connected to at least two other link pairs, through at least one of said internal corner pivot joints;

wherein said loop assembly has a unique polygon perimeter outline comprising a ring of line-segments, each line segment comprised of a line which intersects two perimeter corner joints of one of said link pairs, said line segments being equivalent in number to the number of link pairs in said loop assembly; and wherein the angle formed between any two line-segments corresponding to a particular two link pairs in a given position of the loop assembly, is the same as the similarly formed angle between the line segments corresponding to the same two link pairs for any other position of the loop assembly, whereby the size of the ring of line-segments increases with expansion of said loop assembly and decreases with retraction of said loop assembly.

2. A loop assembly according to claim 1, wherein said connection between adjacent link-pairs are direct pivot connections between said internal corner pivot joints of said adjacent link-pairs.

3. A loop assembly according to claim 1, further comprising one or more hub elements for connecting said internal corner pivot joints of said adjacent link pairs thereto.

4. A structure reversibly expandable from a folded to an unfolded position with partially unfolded positions therebetween, comprising at least two loop assemblies in accordance with claim 1, interconnected by said perimeter corner pivot joints.

5. A structure according to claim 1, further comprising one or more link pairs having at least one perimeter pivot joint, connected by said perimeter pivot joint to said loop assembly.

6. A structure according to claim 4 having a three dimensional shape.

7. A structure according to claim 6, further comprising a plurality of loop assemblies connected together by the corner joints of said links of said loop assemblies, wherein at least one of said connection of said plurality of loop assemblies joins together three or more of said links, to form a reversibly expandable three-dimensional matrix of links.

8. A reversibly expandable three dimensional structure according to claim 6, wherein at least one of said loop assemblies in accordance with claim 1 comprise at least two link pairs lying in different planes and wherein the angle formed between any two planes of any two link pairs of said loop assembly is substantially constant in any position of said structure.

9. A loop assembly in accordance to claim 1, further comprising at least one sheet of material, said material comprising a plurality of stiff regions forming the links of the loop assembly and thin flexible regions forming corner pivot joints of said loop assembly and said stiff regions connected together by one or more of said thin flexible regions.

10. A loop assembly according to claim 9, further comprising two sheets of material, said two sheets of material joined together by a plurality of center pivot joint connections.

11. A loop assembly in accordance with claim 10, wherein said center pivot joints are living hinges.

12. A toy construction kit for building one or more reversibly expandable structures comprising a plurality of loop assemblies in accordance to claim 1, said loop assemblies including perimeter corner joints for connecting any two of said plurality of loop assemblies, whereby said plurality of loop assemblies may be assembled together in various combinations forming reversibly expandable structures of various shapes.

13. A toy construction kit for building one or more reversibly expandable structures comprising a plurality of links for assembly into link pairs, each of said links having a polygonal profile with three or more corners, a center joint and at least one corner pivot joint proximate to at least one of said corners for pivotally connecting two adjacent links.

14. A toy construction kit according to claim 13, further comprising one or more hub elements, each of said hub elements to be shared by two or more of said links as a pivotal connection therebetween.

15. A toy construction kit according to claim 13, further comprising at least two links having at least three corner pivot joints.

16. A reversibly expandable loop assembly comprising:

a plurality of links having a polygonal profile with three or more corners, a center pivot joint and a plurality of corner pivot joints, each of at least two of said plurality of corner pivot joints proximate to at least two of said three or more corners, respectively, said plurality of corner pivot joints comprising at least one internal corner pivot joint and at least one perimeter corner pivot joint proximately located to the outer edge of said loop assembly;

each of said plurality of links connected to another one of said plurality of links at said center pivot joint thereby forming a link pair, said loop assembly comprising at least three link pairs:

each of said at least three link pairs connected to at least two link pairs, each of said two link pairs connected through at least one of said internal corner pivot joints of a link in each of said two link pairs, said perimeter corner pivot joint comprising a ball and socket arrangement.

17. A loop assembly according to claim 1, which further comprises an additional loop of connecting links, said connecting links each having an elongated profile, and each having one center joint and two terminal joints, wherein:

each terminal joint of each connecting link is pivotally connected to an adjacent connecting link, thereby forming a loop; and each center joint of each connecting link is pivotally connected to a polygon link in the loop assembly.

18. A reversibly expandable loop assembly comprising:

a plurality of links having a polygonal profile with three or more corners, a center pivot joint and a plurality of corner pivot joints, each of at least two of said plurality of corner pivot joints proximate to at least two of said three or more corners, respectively, said plurality of corner pivot joints comprising at least one internal corner pivot joint and at least one perimeter corner pivot joint proximately located to the outer edge of said loop assembly;

each of said plurality of links connected to another one of said plurality of links at said center pivot joint thereby forming a link pair, said loop assembly comprising at least three link pairs; and each of said at least three link pairs connected to at least two other link pairs, through at least one of said internal corner pivot joints.

19. A loop assembly according to claim 2, wherein each of said perimeter corner pivots has itself a pivotal connection to its corresponding polygon link pair, the axis of said pivotal connection lying essentially within the plane of said polygon link pair.

20. A loop assembly according to claim 19, wherein each perimeter corner pivot has one or more flexible regions such that said flexible region of said corner pivot shall flexibly deform when brought together with the flexible region of a corner pivot belonging to another loop assembly, said flexible regions then snapping back to an unstrained condition as the two corner pivots are brought into alignment, thus forming a pivotal attachment between said two perimeter corner pivots, thereby forming a hub element that acts essentially as a ball joint having three intersecting axes of rotation.

21. A toy construction kit for building reversibly expanding structures according to claim 12, comprising a plurality of loop assemblies according to claim 20.

22. A toy construction kit for building reversibly expandable structures according to claim 12, further including at least one scissor-pair, said scissor pair comprised of two links pivotally connected together at a center pivot joint, two ends of each of said two links each having a terminal pivot point that has itself a pivotal connection to its corresponding link, the axis of said pivotal connection lying essentially within the plane formed by said scissor pair.

23. A toy construction kit for building reversibly expandable structures according to claim 12, further including means to attach two loop assemblies together in a stacked arrangement.

24. A toy construction kit for building reversibly expandable structures according to claim 12, further including separate hub elements that may be attached to points on loop assemblies to provide extra attachment points.

* * * * *